United States Patent [19]

Giese et al.

[11] Patent Number: 5,025,573

[45] Date of Patent: Jun. 25, 1991

[54] MULTI-DENSITY SHOE SOLE

[75] Inventors: Erik O. Giese; Roger J. Brown, both of Aspen, Colo.

[73] Assignee: Comfort Products, Inc., Aspen, Colo.

[21] Appl. No.: 871,017

[22] Filed: Jun. 4, 1986

[51] Int. Cl.[5] ..... A43B 13/14; A43B 13/12

[52] U.S. Cl. ..... 36/30 R; 36/31; 36/28

[58] Field of Search ..... 36/30 R, 31, 28, 32 R, 36/25 R, 103, 92, 82, 107, 108, 76 R, 76 C, 22 A, 11.5

[56] References Cited

U.S. PATENT DOCUMENTS

| | | | |
|---|---|---|---|
| 1,701,611 | 2/1929 | Glidden et al. | 36/30 R |
| 1,711,788 | 5/1929 | Incutti | 36/76 R |
| 1,993,208 | 3/1935 | Cohn | 36/76 R |
| 2,217,641 | 10/1940 | Kamborian et al. | 36/31 |
| 2,410,019 | 10/1946 | Davis | 36/28 |
| 2,457,481 | 12/1948 | MacArthur | 36/76 R |
| 3,824,716 | 7/1974 | DiPaolo | 36/32 R |
| 4,124,946 | 11/1978 | Tomlin | 36/30 R |
| 4,130,947 | 12/1978 | Denu | 36/30 R |
| 4,302,892 | 12/1981 | Adamik | 36/31 |
| 4,316,332 | 2/1982 | Giese et al. | 36/30 R |
| 4,364,188 | 12/1982 | Turner et al. | 36/31 |
| 4,364,189 | 12/1982 | Bates | 36/31 |
| 4,366,629 | 1/1983 | Scherz | 36/76 R |
| 4,377,041 | 3/1983 | Alchermes | 36/30 R |
| 4,399,620 | 8/1983 | Finck | 36/30 R |
| 4,439,937 | 4/1984 | Daswick | 36/108 |
| 4,449,306 | 5/1984 | Cavanagh | 36/30 R |
| 4,455,765 | 6/1984 | Sjosward | 36/30 R |
| 4,547,979 | 10/1985 | Harada et al. | 36/31 |
| 4,561,140 | 12/1985 | Graham et al. | 36/30 R |
| 4,561,195 | 12/1985 | Onoda et al. | 36/31 |

FOREIGN PATENT DOCUMENTS

| | | | |
|---|---|---|---|
| 262315 | 5/1963 | Australia | 36/76 R |
| 2643237 | 4/1978 | Fed. Rep. of Germany | 36/30 R |
| 1108042 | 1/1956 | France | 36/76 R |
| 283034 | 5/1952 | Switzerland | 36/82 |
| 2007081 | 5/1979 | United Kingdom | 36/30 R |
| 2046579 | 11/1980 | United Kingdom | 36/11.5 |

*Primary Examiner*—Steven N. Meyers
*Attorney, Agent, or Firm*—Pennie & Edmonds

[57] ABSTRACT

A composite shoe bottom is disclosed comprising a lower layer of firm material and an upper softer layer superposed thereon. Each layer has an upper contoured surface such that the total compressibility of the shoe bottom, as determined by the relative thicknesses of the layers, is predetermined and differs along the surface. The upper layer has an uppermost surface which is shaped to fit against and be complemental to the bottom of the foot of a wearer.

40 Claims, 30 Drawing Sheets

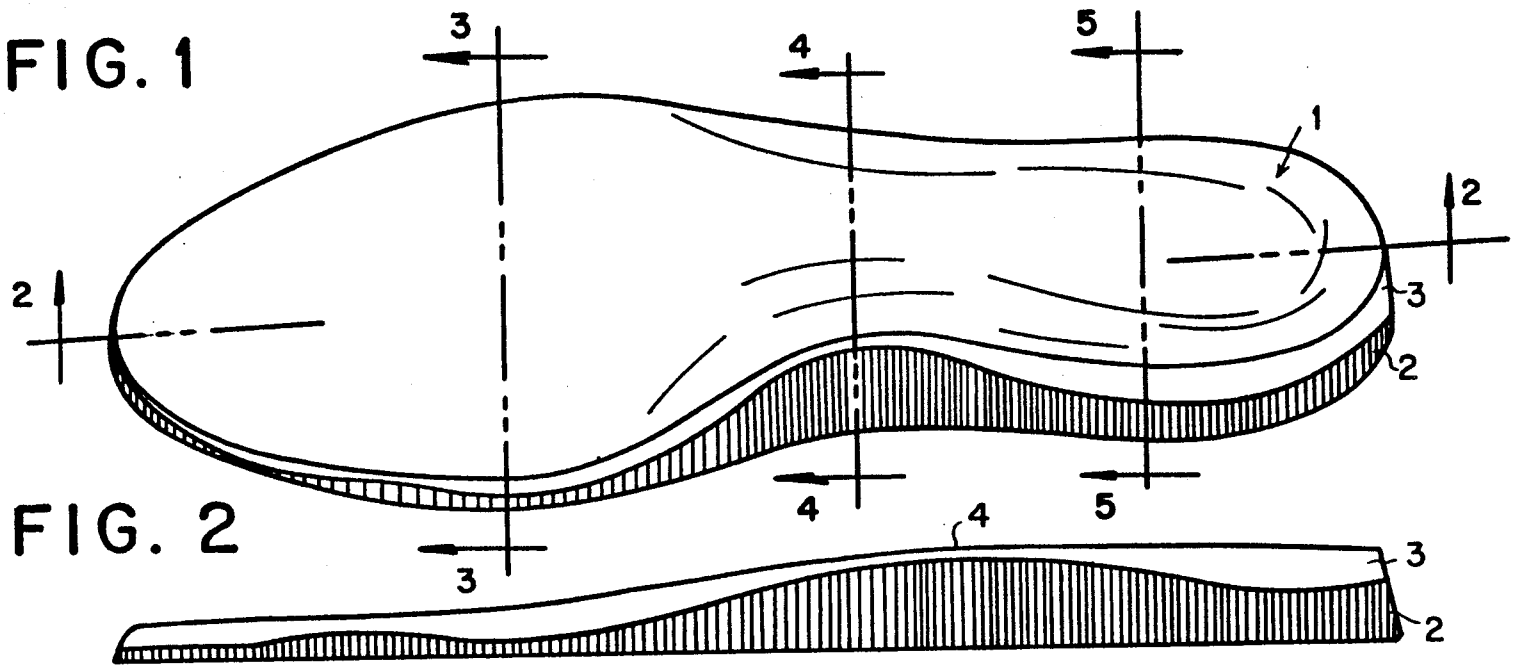
FIG. 1
FIG. 2
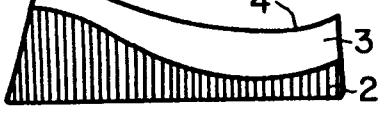
FIG. 4
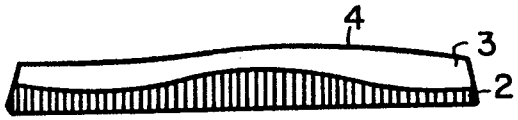
FIG. 3
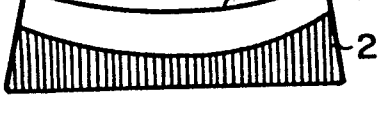
FIG. 5

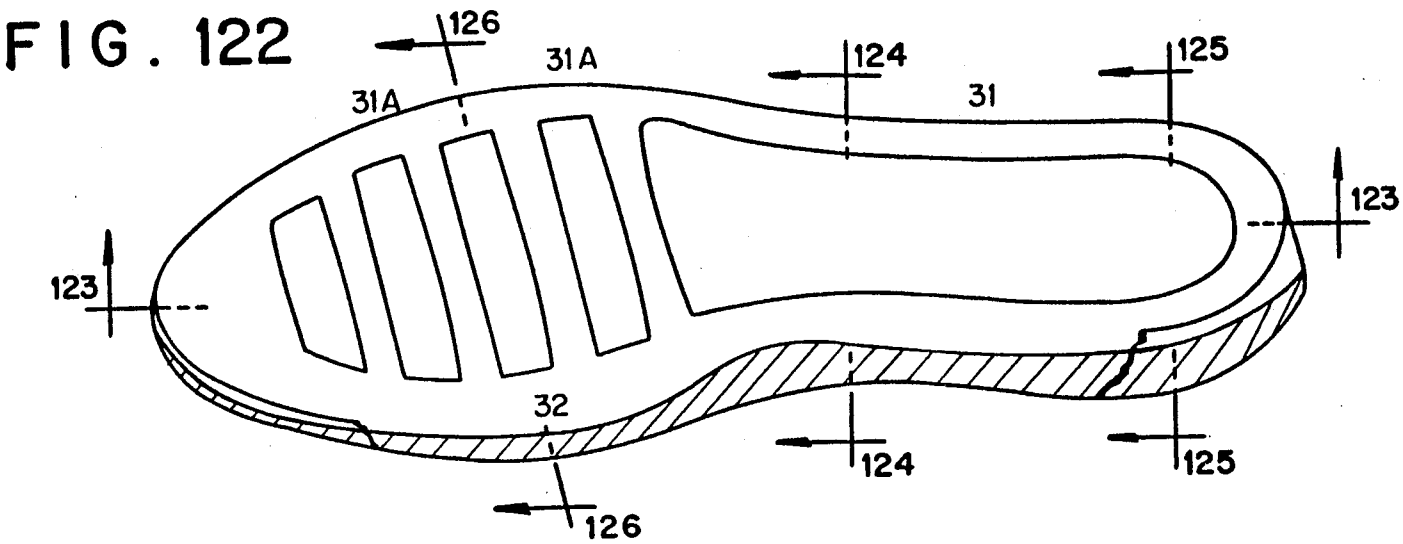
FIG. 122
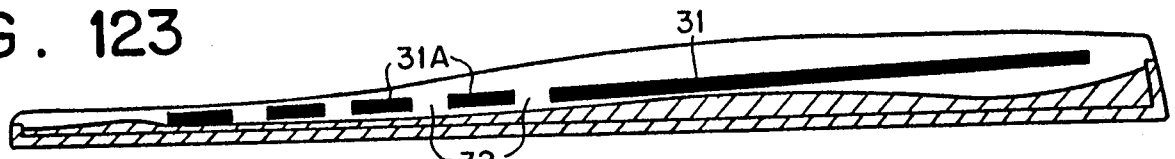
FIG. 123
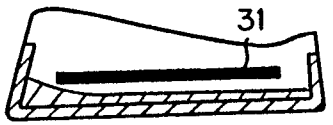
FIG. 125
FIG. 124
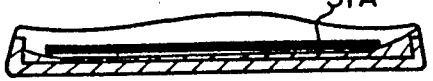
FIG. 126

MULTI-DENSITY SHOE SOLE

FIELD OF THE INVENTION

The invention relates to shoes and in particular to shoes having sole portions formed of substances having two or more density-resilience qualities.

DESCRIPTION OF THE RELATED ART

Historically, shoe bottoms have consisted primarily of flat surfaces on both their top and bottom. These bottoms were normally made of single density polyurethane (PU) or blown polyvinylchloride (PVC) type material. The upper of the shoe would be glued onto the top of the sole or the upper could be "direct attached" through a molding process which would capture the upper in the molded sole. The bottom could be the lowermost layer of the sole if the urethane was sufficiently abrasion resistant, or alternatively a rubber outsole would be cemented onto the unit bottom, as is typically done in running shoes.

Eventually, it became known to contour the top surface of the unit bottom to provide a heel cup and slight arch. This made the shoe more comfortable because the foot would rest on a surface similar to its shape as opposed to a flat surface which felt like flat feet on a firm floor.

When the contour surface is used with a dual-density bottom, that is two different densities of PU, the lowermost (outer) portion is formed of a uniform thickness. This portion is chosen for its abrasion resistance. The softer portion is positioned on top of this uniform portion to provide comfort and cushioning as the firmer material would be too hard for comfort. Further, the respective volumes of the softer and firmer materials are such that the volume of soft material is maximized and the volume of firmer material is minimized.

The prior known structures have always had to trade cushioning for stability. If the bottom is soft for good cushioning, then the foot rocks from side-to-side and this is unstable. Even existing soles with contoured top-most surfaces have this type of trade-off.

It has been proposed, for example, in U.S. Pat. No. 4,399,620 to Herbert Funck and U.S. Pat. No. 4,446,633 to Scheinhaus et al. to contour the lower wear-resistant layer but provide a relatively flat second layer which is deformable rather than double contoured. Each of these designs, however, provides a flat surface which must be deformed by the foot to obtain a satisfactory shape, thus losing much of the support which was to be provided by the bottom.

SUMMARY OF THE INVENTION

The shoe bottom of the present invention provides double contouring in the firmer wear-resistant layer and in the softer second layer of the bottom. One advantage to this structure resides in the firmer material providing support unavailable when the softer portion is too thick. This permits soft comfort next to the foot while still providing firm support to prevent excess pronation. By forming the bottom so the firmer material rises toward the edges, lateral stability is provided while allowing cushioning where it is needed such as under the heel and ball of the foot areas. Arch support may be provided by the firmer material in a more efficient manner than merely thickening the upper soft portion.

The composite shoe bottom of the present invention has a lower shaped layer with an increased height around the heel area and in the arch area. This forms an upper stabilizing surface for the wearer's foot. An upper cushioning layer, which is softer than the lower layer, is superposed in face-to-face relation upon the upper surface of the lower layer. The upper layer has a varying thickness to define an uppermost surface which is shaped to a contour complementary to the bottom surface of the wearer's foot.

In the shoe bottom of the invention, the composite of the firmer wear-resistant layer and the softer second layer of the shoe bottom creates a combined flexibility of the shoe bottom. The two layers may not have the same shape to their upper surface. By varying the portion of the shoe bottom thickness that each layer makes up, a total elasticity or compression which changes with position is obtained. Thus, a shoe is formed providing cushioning where needed and stability where needed.

In a further embodiment of the invention the shoe bottom is provided with an internal stiffener member. The stiffener member or internal comfort stabilizer provides an amount of rigidity to part of the shoe bottom so it flexes at the metatarsal region and not further back toward the heel. This type of structure provides a light weight shoe bottom without sacrificing the necessary stiffness in the portion of the shoe bottom from in front of the arch back to the heel.

The top surface of the stiffener member may be flat or contoured to provide stabilizing support to the upper contoured layer. This contoured surface is especially advantageous in rugged type applications of footwear. In women's footwear the member is extremely advantageous for use in high-heeled shoes. The high heel requires very strong support over a very long distance.

The stiffener member is insertion molded with the shoe bottom and is thereby securely mounted within the shoe bottom.

In a further embodiment a multiple number of stabilizers are insertion molded into the shoe bottom. The stabilizers may run across the shoe bottom with flex portions in between. This provides for torsional rigidity with flexibility about the ball of the foot. The stabilizers may have a T-shaped cross-section for additional strength; the lower layer may have upward projections to hold the stabilizer while the soft layer is molded into the shoe bottom.

BRIEF DESCRIPTION OF THE DRAWINGS

FIG. 1 is a perspective view of the composite shoe bottom of the invention;

FIG. 2 is a longitudinal cross-section of the shoe bottom of FIG. 1,;

FIG. 3 is a transverse cross-section along lines 3—3 of FIG. 1;

FIG. 4 is a transverse cross-section along lines 4—4 of FIG. 1;

FIG. 5 is a transverse cross-section along lines 5—5 of FIG. 1;

FIG. 122 is a perspective view showing transverse stabilizers for torsional rigidity;

FIG. 123 is a longitudinal cross-section along lines 123—123 of FIG. 122;

FIG. 124 is a transverse CrosS-section along lines 124—124 of FIG. 122;

FIG. 125 is a transverse cross-section along lines 125—125 of FIG. 122;

FIG. 126 is a transverse cross-section along lines 126—126 of FIG. 122;

FIG. 127 shows a full-length version of the stabilizer;

FIG. 128 is a longitudinal cross-section along lines 128—128 of FIG. 127;

FIG. 129 is a transverse cross-section along lines 129—129 of FIG. 127;

FIG. 130 is a transverse cross-section along lines 130—130 of FIG. 127;

FIG. 131 is a transverse cross-section along lines 131—131 of FIG. 127;

FIG. 132 is a perspective view of a full-length stabilizer for low flexibility applications;

FIG. 133 is a longitudinal cross-section along lines 133—133 of FIG. 132;

Figure 132:
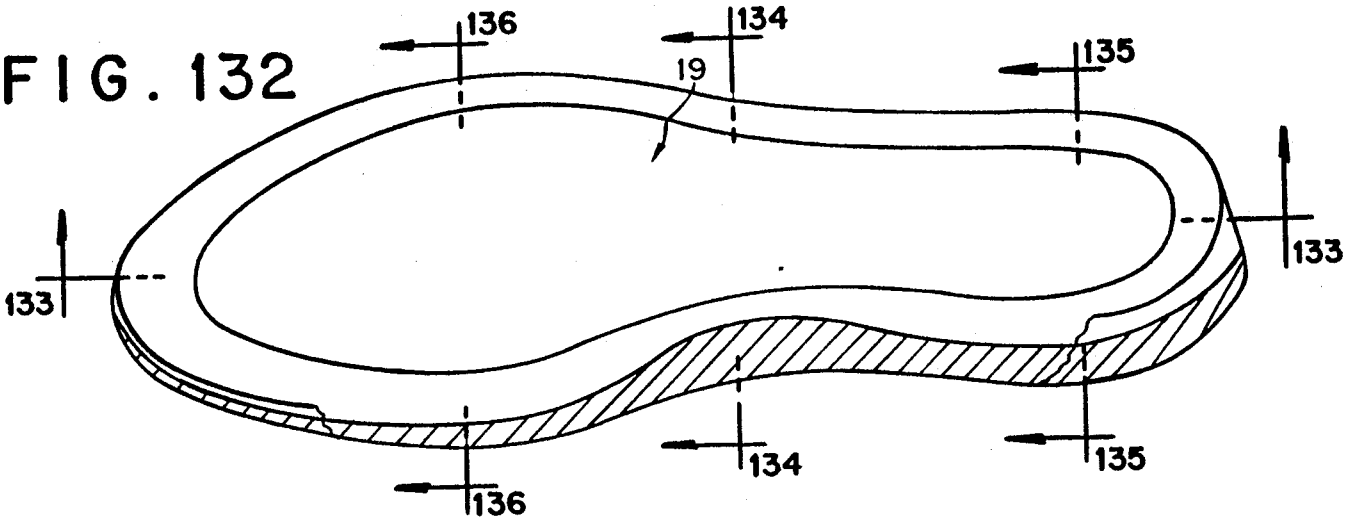
Figure 133:
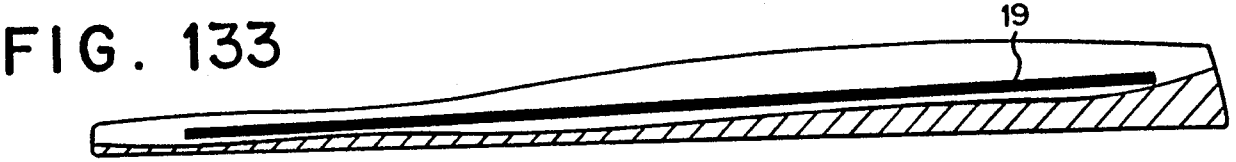
Figure 135:
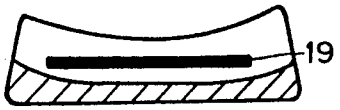
Figure 134:
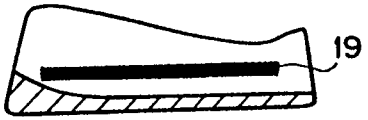
Figure 136:
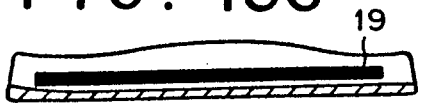

FIG. 134 is a transverse cross-section along lines 134—134 of FIG. 132;

FIG. 135 is a transverse cross-section along lines 135—135 of FIG. 132;

FIG. 136 is a transverse cross-section along lines 136—136 of FIG. 132;

DESCRIPTION OF THE EMBODIMENTS

Referring to FIG. 1, there is shown the composite shoe bottom 1 according to the invention. A firm lower layer 2 is shaped to be thicker in areas where the wearer's foot will need extra support. The softer upper layer 3 is in face-to-face engagement with the upper surface of the lower layer 2. The upper layer 3 has an uppermost surface 4 which is contoured to be complemental to the shape of a human foot bottom. As can be seen in FIG. 2, the softer layer is thinnest in the area needing the most support; for example, where the heel of the foot will rest (FIG. 5). This feature is further shown in FIGS. 3–5. As can be seen, support for the ball of the foot (FIG. 3) is relatively uniform, but the bulge of firmer material in the lower layer provides a flex axis which assists in propulsion by providing a built-in rocker function. This further supplies a metatarsal arch support. However, the arch (FIG. 4) is usually provided with a thick firm portion 2 and relatively thin softer portion 3 in the area directly beneath the arch. This relationship changes across the shoe bottom away from the arch until, as shown at the right of FIG. 4, the softer upper layer and lower layer are approximately equal in thickness. The relative thicknesses may be changed to provide a thicker soft layer and thinner firm layer. This saves weight in running shoes. The heel portion (FIG. 5) has a cup shape provided in the lower layer and less drastic cup shape of the softer layer in composite. This shoe bottom provides extra firmness and support on the outside edges of the heel to prevent pronation and supination or side-to-side rocking and instability. At the same time, the inner area of the heel is softer because the upper soft layer is thicker. This softens the impact on the heel during walking or running. This further forces the foot's fatty tissue inward beneath the heel to assist the shock absorbing function of the fatty tissue.

The two sole pieces may be preformed and glued or ultrasonically welded to one another. However, it is more convenient to mold the softer layer directly onto the firmer lower layer. When molded together, the heat of molding the second layer causes attachment of the two layers.

The shaped lower layer has a predetermined hardness which is capable of maintaining its shape against the wearer's weight. The predetermined hardness permits the layer to flex, move and distort under the weight without permanently deforming. The upper layer is similarly made of a material that does not permanently deform.

Currently known dual density polyurethane polymers have a range of density from a soft 0.25 to a more dense 1.1. The hardness of the layers is expressed in terms of the Shore "A" hardness scale. The softer upper layer ranges in shore hardness between 25 and 40. The firmer lower layer has a hardness range from 50 to 75. The softer layer, however, could go as soft as 25 with a density of 0.25, because of the support provided by the lower layer.

Figure 11:
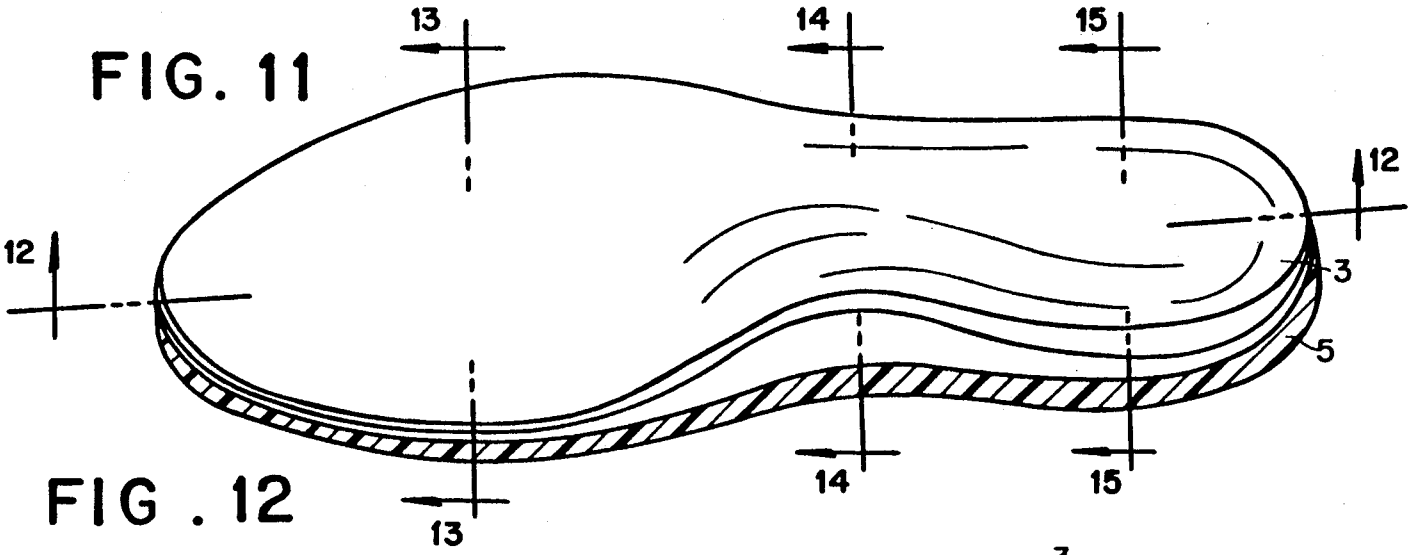
FIG. 11 is a cross-sectional view of an embodiment of the invention with three layers.
Figure 12:
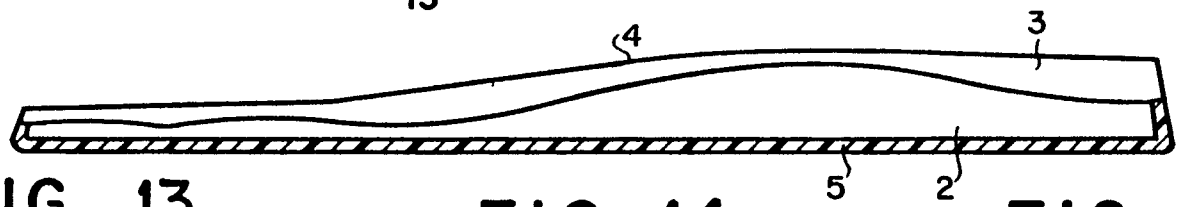
FIG. 12 is a longitudinal cross-section along lines 12—12 of FIG. 11.
Figure 15:
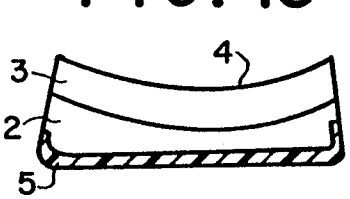
FIG. 15 is a transverse cross-section along lines 15—15 of FIG. 11.
Figure 14:
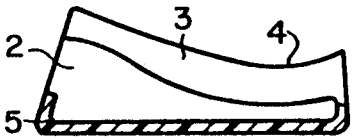
FIG. 14 is a transverse cross-section along lines 14—14 of FIG. 11.
Figure 13:
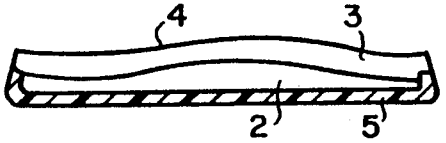
FIG. 13 is a transverse cross-section along lines 13—13 of FIG. 11.

Casual type shoes, such as those with leather uppers which are worn for street use, for walking and reasonably dressy occasions, have a top layer with a hardness of 25–35 and a density of 0.30–0.45. The lower layer of this type of shoe has a hardness of 55–70 and density of 0.75–95. An athletic shoe used for running or tennis has an upper layer hardness of 30–40 and a density of 0.4–0.6, while its lower layer has a hardness of 65–75 and a density of up to 1.1. Additionally, most basketball and running shoes would have a rubber outsole 5 on them for traction and slip resistance (FIG. 11).

Figures 6, 7, 8, 9, 10:
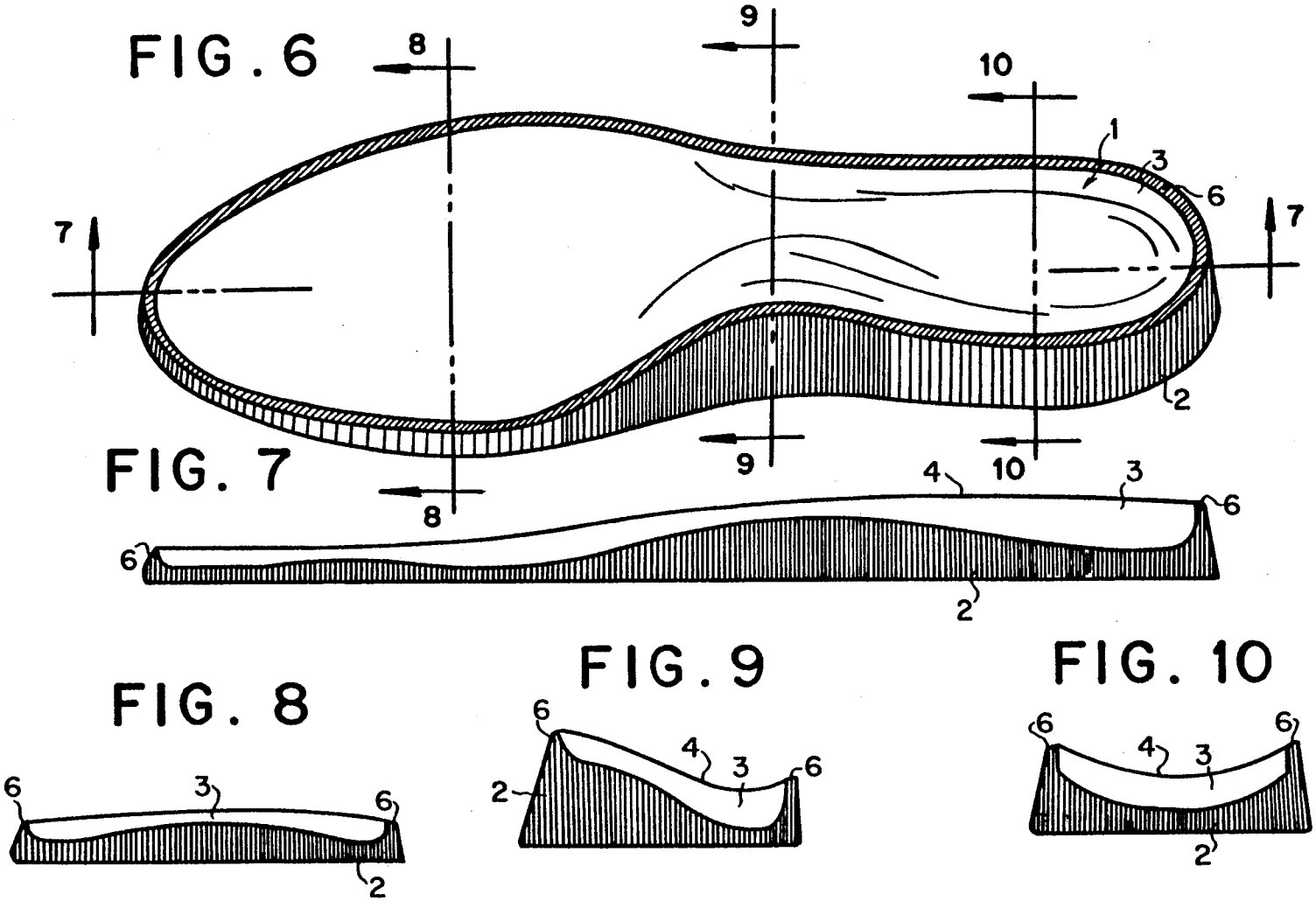
FIG. 6 is a perspective view of a second embodiment of the invention having a lateral support rim.
FIG. 7 is a longitudinal cross-section along lines 7—7 of FIG. 6.
FIG. 8 is a transverse cross-section along lines 8—8 of FIG. 7.
FIG. 9 is a transverse cross-section along lines 9—9 of FIG. 7.
FIG. 10 is a transverse cross-section along lines 10—10 of FIG. 7.

In order to prevent permanent deformation of the softer upper layer, the firmer lower layer may be provided with a cup shape as shown in FIGS. 6–10. The rim 6 rises to the same level as the uppermost surface 4 of the upper layer 3, thereby surrounding and supporting it. This prevents the softer layer from deforming sideways and thereby compressing too far and allowing early failure of the softer layer. This action is similar to the effect of the cup under the heel which was described above. By supporting the outer portion, the softer layer is maintained in the center of the shoe bottom to assist its shock absorbing function. The rim 6 may surround only a portion of the upper layer such as the heel (FIG. 10). However, it may also surround the entire outer edge of the upper layer (FIGS. 8–10).

FIGS. 11–15 show the shoe bottom of the present invention with a rubber outsole 5. The outsole may cover only the bottom of the lower layer or it may turn up the outside of the lower layer as shown in FIGS. 12–15. The rubber outsole 5 provides traction and abrasion resistance for the bottom of the shoe bottom. When outsole 5 is used the two densities of PU may be molded into the shell sole (outsole) otherwise the outsole may be glued or bonded to the layers.

Figures 16, 17, 18, 19, 20:
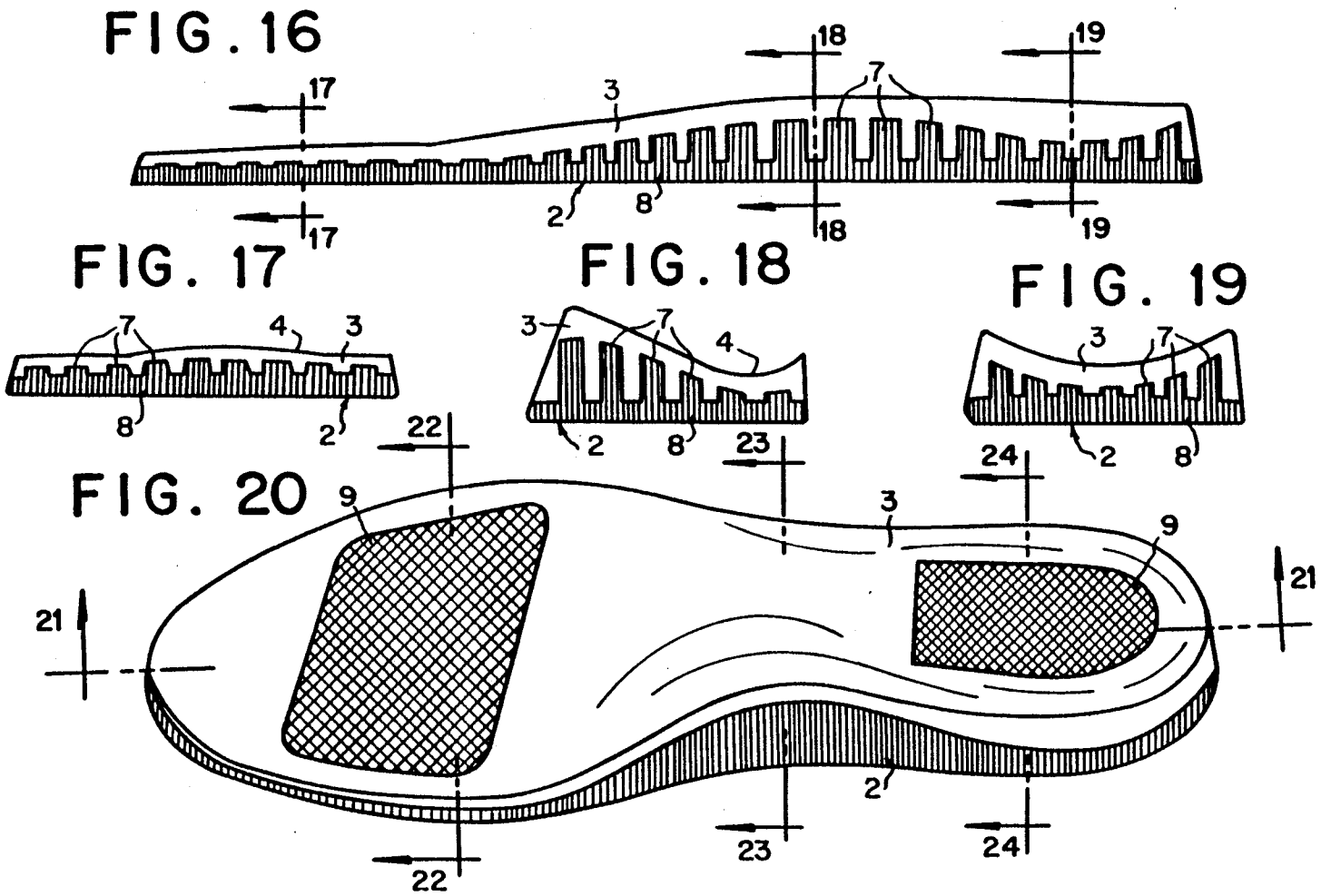
FIG. 16 is a longitudinal cross-sectional view of a third embodiment ,of the invention.
FIG. 17 is a transverse cross-sectional view of the embodiment shown in FIG. 16.
FIG. 18 is a transverse cross-section along lines 18—18 of FIG. 16.
FIG. 19 is a transverse cross-section along lines 19—19 of FIG. 16.
FIG. 20 is a perspective view of a fourth embodiment of the ,invention having shock absorbing inserts.
Figure 21:
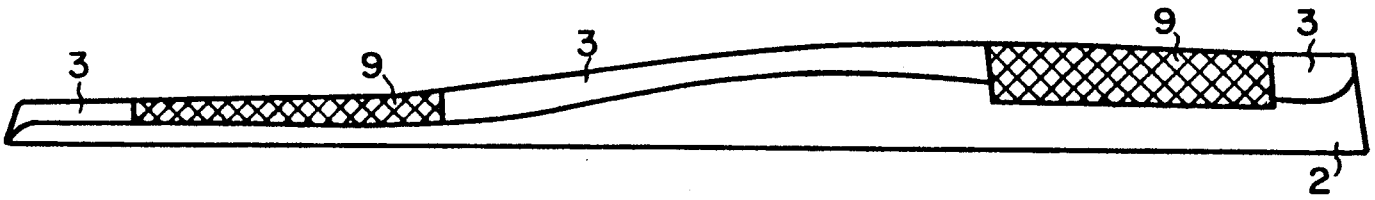
FIG. 21 is a longitudinal cross-sectional view of the embodiment of FIG. 20.
Figure 23:
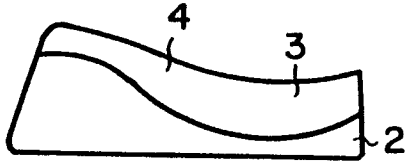
FIG. 23 is a transverse cross-section along lines 23—23 of FIG. 20.
Figure 24:
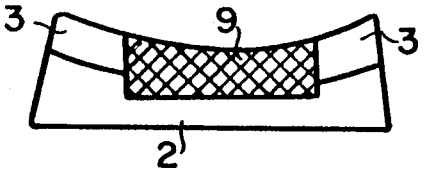
FIG. 24 is a transverse cross-section along lines 24—24 of FIG. 20.

A further embodiment (FIGS. 16–19) permits a fine tuning of the composite flexibility of the shoe bottom. Finger-like projections 7 are used to form the upper portion of lower layer 2. The projections extend upward from a base 8. The softer layer is injection molded over the projections allowing the softer material to flow into the interstices between the projections 7. This provides a softer shoe bottom as the projections 7 may each deform sideways when compressed downward. The bulging, distorting and deforming sideways provides more comfort at a slight reduction in support. The finger-like projection extends a greater height from base 8 at certain points to provide raised support. For example, FIG. 18 shows the longer projections beneath the arch area of the shoe bottom. FIG. 19 also shows longer projections to the outside of the heel portion to provide cupping for the heel as previously described.

Figure 22:
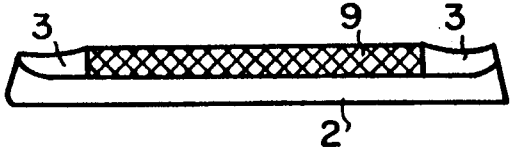
FIG. 22 is a transverse cross-section along lines 22—22 of FIG. 20.
Figure 25:
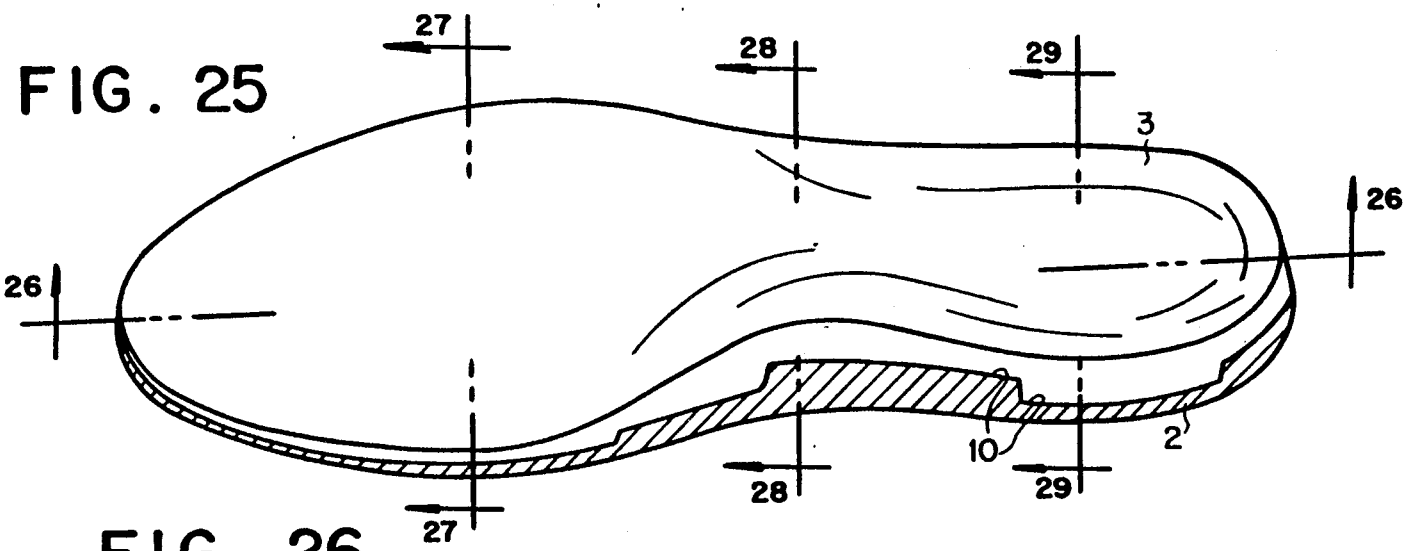
FIG. 25 is a perspective view of a sixth embodiment of the invention.
Figure 26:
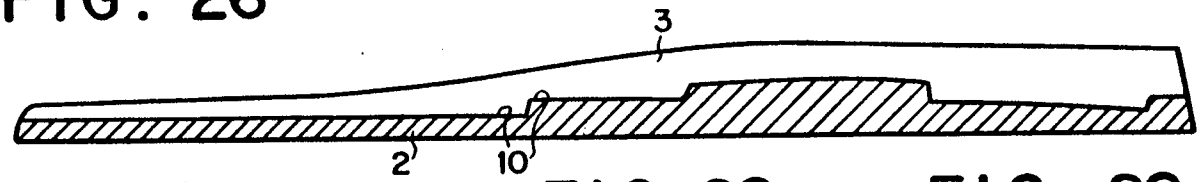
FIG. 26 is a longitudinal cross-section along lines 26—26 of FIG. 25.
Figure 29:
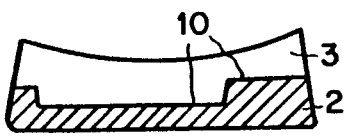
FIG. 29 is a transverse cross-section along lines 29—29 of FIG. 25.
Figure 28:
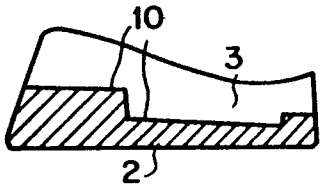
FIG. 28 is a transverse cross-section along lines 28—28 of FIG. 25.

FIG. 20 shows the shoe bottom of the present invention with the addition of shock foam inserts 9. The inserts 9 are positioned beneath the portions of the foot which take the large shock forces generated in activities such as running. As is seen in FIGS. 21–24, the shock foam inserts extend upward from the lower layer to provide additional cushioning for the foot. The inserts may extend slightly into the lower layer (FIG. 24) or may extend from its upper surface (FIG. 22). These inserts 9 may be molded in as a third density of PU rather than separate shock foam pieces.

FIGS. 25–29 show a further embodiment of the shoe bottom. The firmer material is formed with a stepped surface rather than the gently curved surface of FIGS. 1–5. The firmer layer need not be shaped to smooth perfection. In the embodiment of FIGS. 25–29, the softer upper layer will smooth out imperfections in the lower, firmer layer even though step changes 10 in thickness of the lower layer are used.

FIGS. 30–34 show the embodiment of FIGS. 25–29 with the addition of a rim 6. As described above, rim 6 provides additional lateral support to the upper layer while preventing permanent deformation of the upper layer.

FIGS. 35–44 show the shoe bottom with the addition of stability inserts 11 and 12. The stability inserts are positioned to create a portion of much greater support. The stability inserts are preformed and then positioned in the mold prior to injection molding the shoe bottom. The inserts are positioned to provide greater support to discrete portions of the foot, for example, the u-shaped insert which is placed around the perimeter of the heel provides greater support on the outside of the heel, forcing the body's fatty tissues inward to provide natural cushioning to the central part of the heel as was described above.

Figures 40, 41, 42, 43, 44:
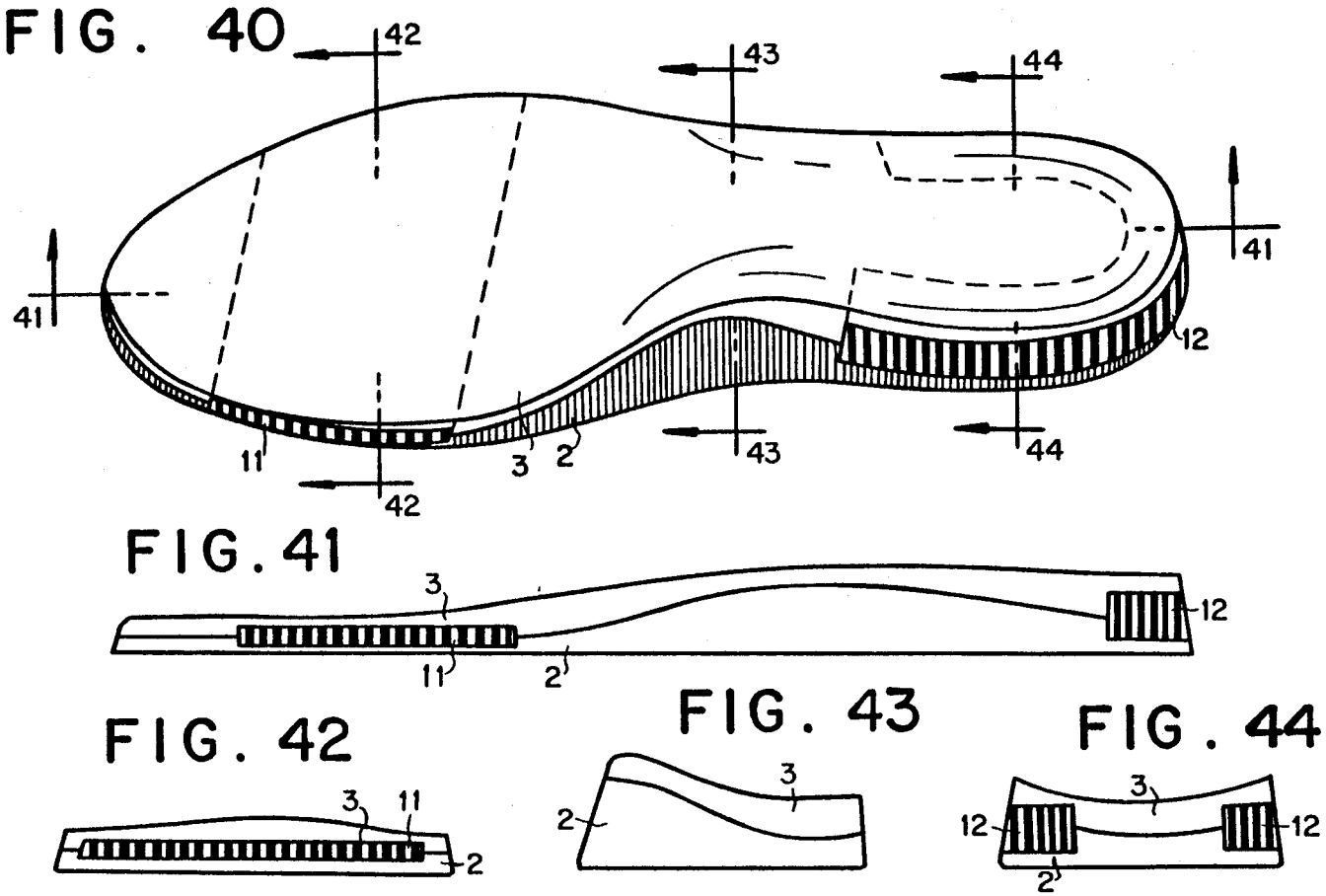
FIG. 40 is a modified version of the shoe bottom of FIG. 35 wherein the upper layer extends over the stabilizing inserts.
FIG. 41 is a longitudinal cross-section along lines 41—41 of FIG. 40.
FIG. 42 is a transverse cross-section along lines 42—42 of FIG. 40.
FIG. 43 is a transverse cross-section along lines 43—43 of FIG. 40.
FIG. 44 is a transverse cross-section along lines 44—44 of FIG. 40.

In order to provide a more continuous upper surface and provide padding between the stabilizing inserts and the foot, the upper layer may extend over the stabilizing inserts (FIGS. 40–44). As is seen in FIG. 40, a heel insert 12 extends upward from the lower layer to provide additional support at the outer marginal portions of the heel (FIG. 44). This insert is covered by a portion of upper layer 3 to pad the insert slightly without substantially diminishing the support provided by the insert to the heel. Similarly, insert 11 of FIG. 42 provides support to the ball of the foot and is padded by upper layer 3.

Figure 45:
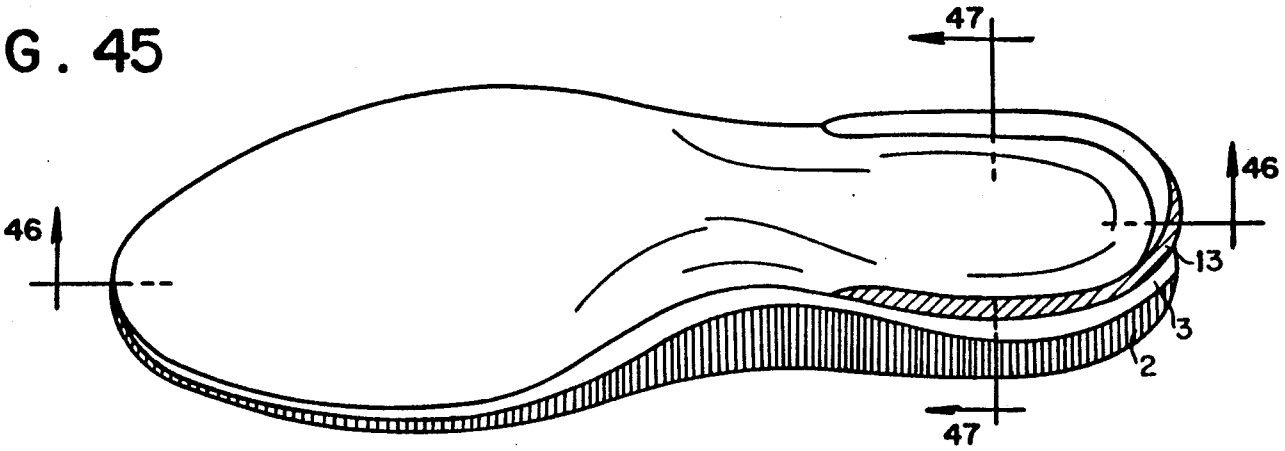
FIG. 45 is a perspective view of the shoe bottom of the invention having an extending heel cup.
Figure 46:
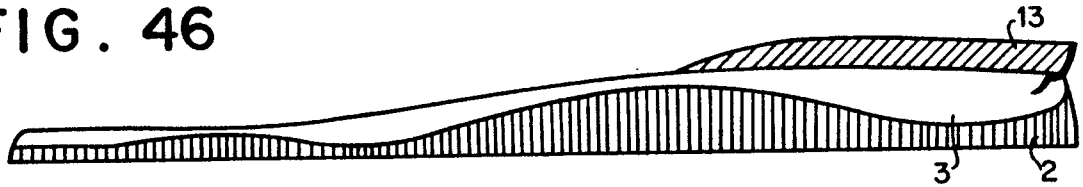
FIG. 46 is a longitudinal cross-section along lines 46—46 of FIG. 45.
Figure 47:
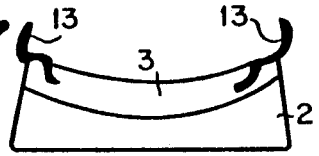
FIG. 47 is a transverse cross-section along lines 47—47 of FIG. 45.
Figure 48:
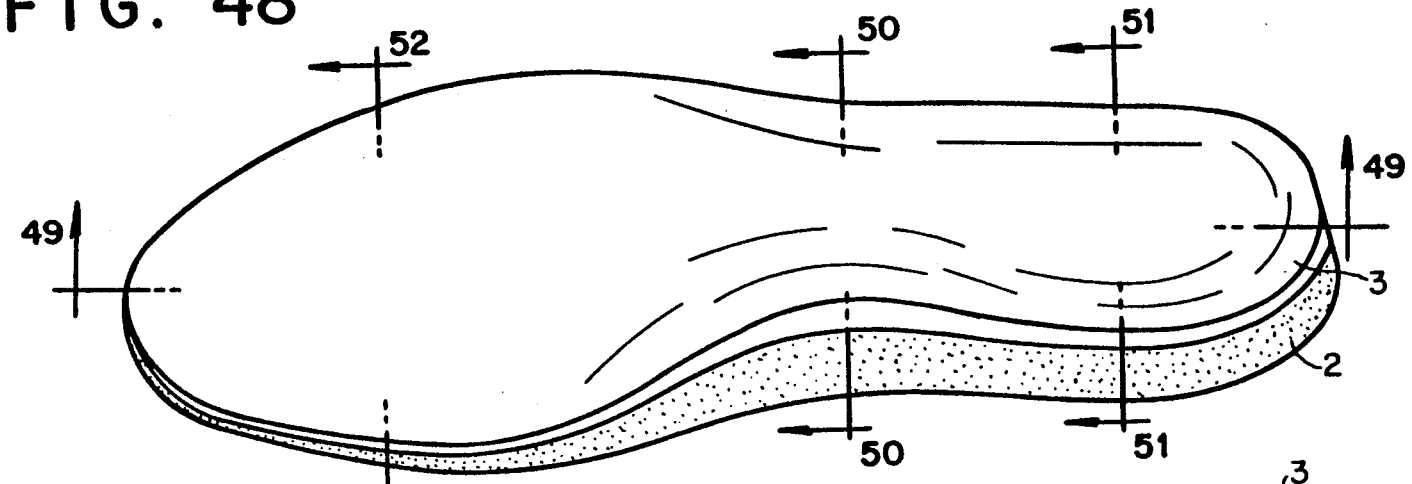
FIG. 48 is a perspective view of the shoe bottom of the invention having a stepped outer periphery.
Figure 49:
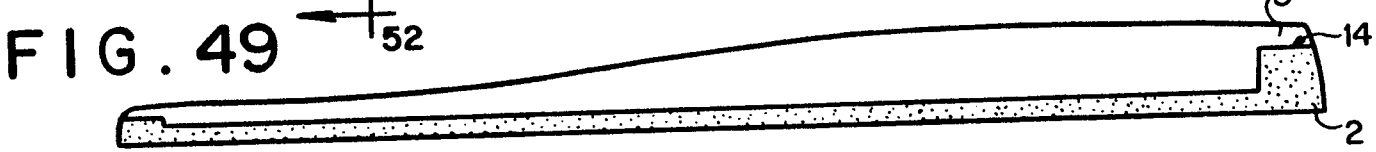
FIG. 49 is a longitudinal cross-section along lines 49—49 of FIG. 48.
Figure 51:
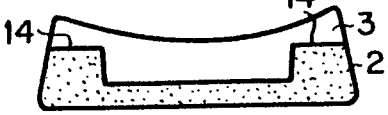
FIG. 51 is a transverse cross-section along lines 51—51 of FIG. 48.
Figure 50:
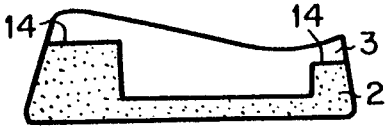
FIG. 50 is a transverse cross-section along lines 50—50 of FIG. 48.
Figure 52:
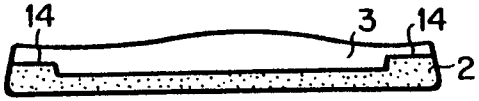
FIG. 52 is a transverse cross-section along lines 52—52 of FIG. 48.
Figure 53:
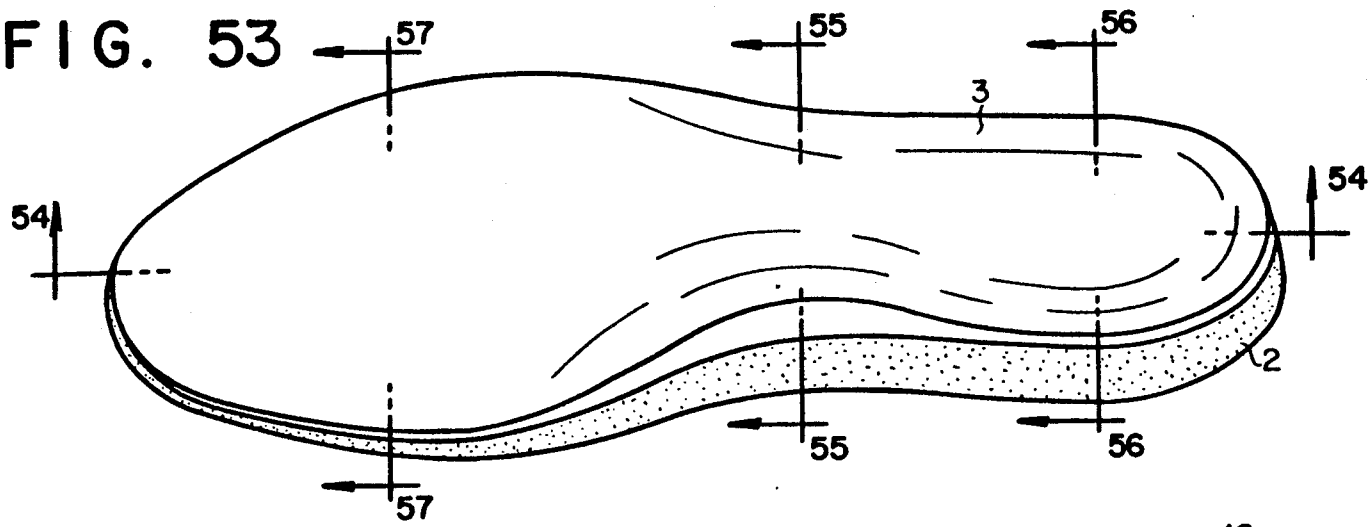
FIG. 53 is a perspective view of a modified version of the shoe bottom of FIG. 48.
Figure 54:
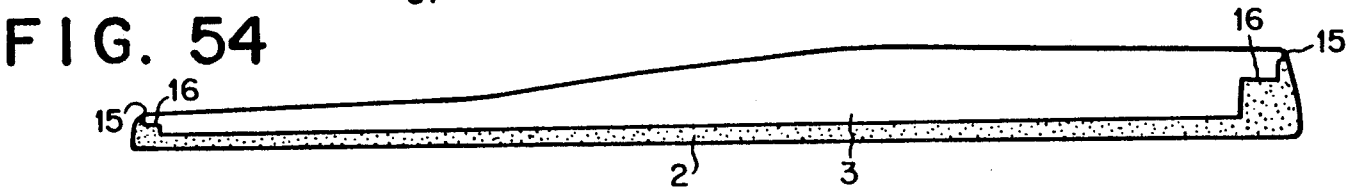
FIG. 54 is a longitudinal cross-section along lines 54—54 of FIG. 53.
Figure 55:
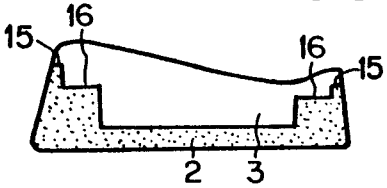
FIG. 55 is a transverse cross-section along lines 55—55 of FIG. 53.
Figure 56:
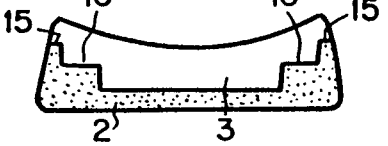
FIG. 56 is a transverse cross-section along lines 56—56 of FIG. 53.
Figure 57:
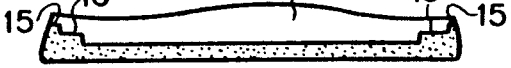
FIG. 57 is a transverse cross-section along lines 57—57 of FIG. 53.
Figure 58:
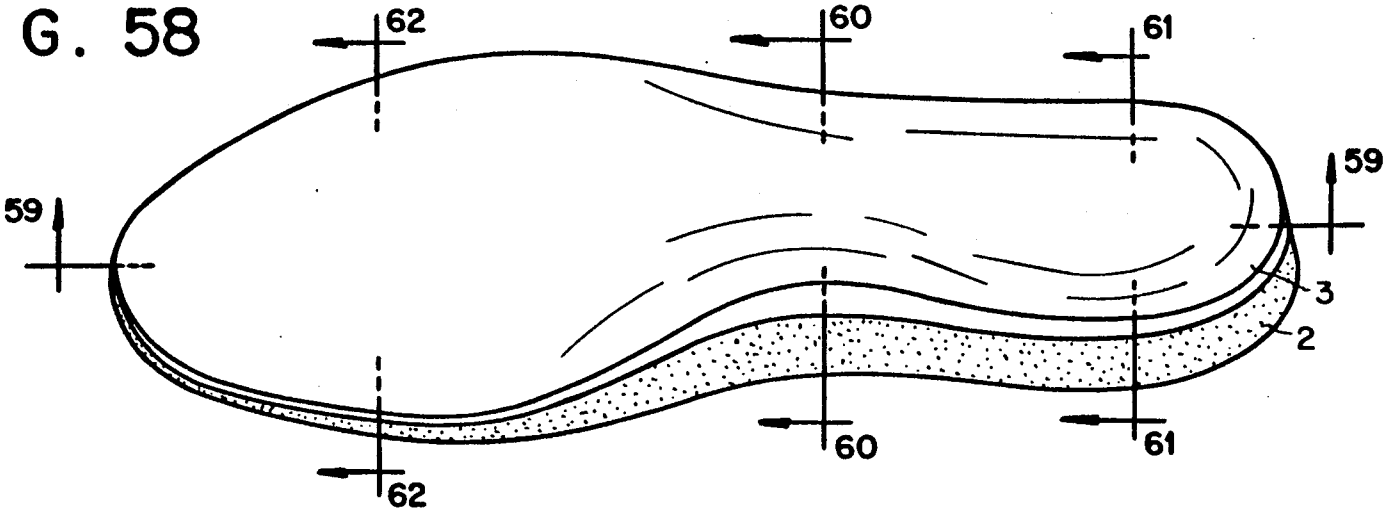
FIG. 58 is a perspective view of the shoe bottom of the invention having a rounded peripheral projection.
Figure 59:
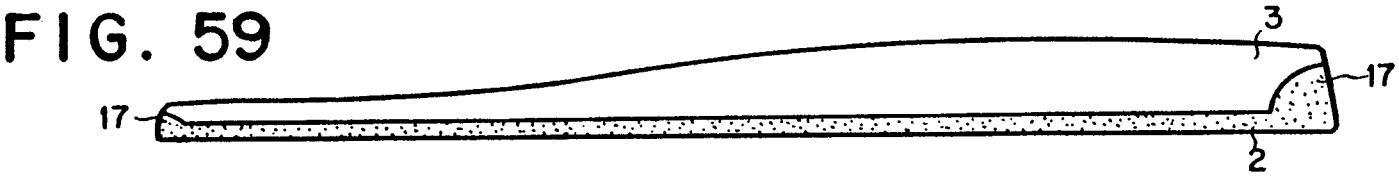
FIG. 59 is a longitudinal cross-section along lines 59—59 of FIG. 58.
Figure 60:
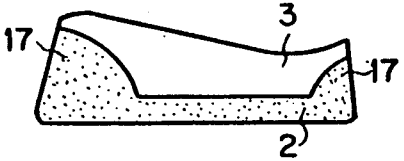
FIG. 60 is a transverse cross-section along lines 60—60 of FIG. 58;,.
Figure 61:
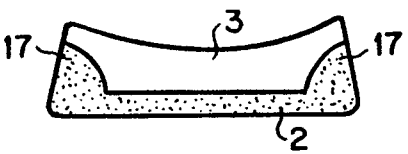
FIG. 61 is a transverse cross-section along lines 61—61 of FIG. 58.
Figure 62:
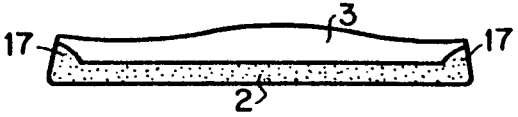
FIG. 62 is a transverse cross-section along lines 62—62 of FIG. 58.
Figure 63:
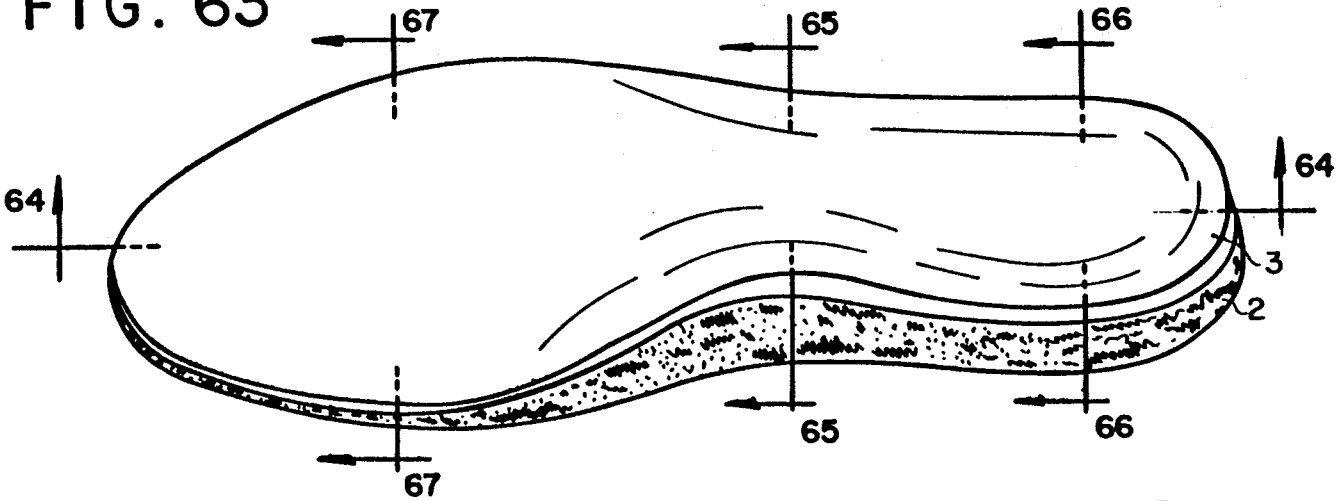
FIG. 63 is a perspective view of the shoe bottom of the invention having, a sloped periphery.
Figure 64:
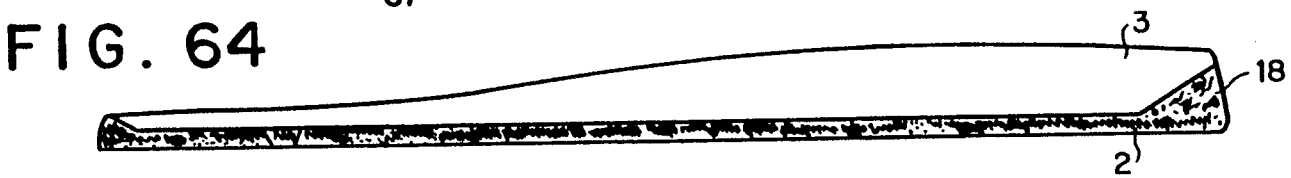
FIG. 64 is a longitudinal cross-section along lines 64—64 of FIG. 63.
Figure 66:
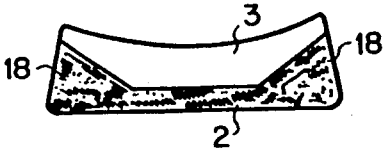
FIG. 66 is a transverse cross-section along lines 66—66 of FIG. 63.
Figure 65:
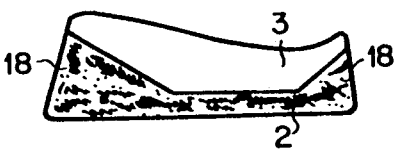
FIG. 65 is a transverse cross-section along lines 65—65 of FIG. 63.
Figure 67:
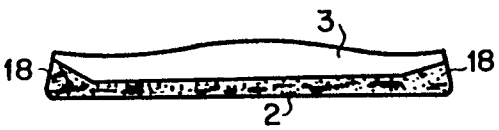
FIG. 67 is a transverse cross-section along lines 67—67 of FIG. 63.
Figure 68:
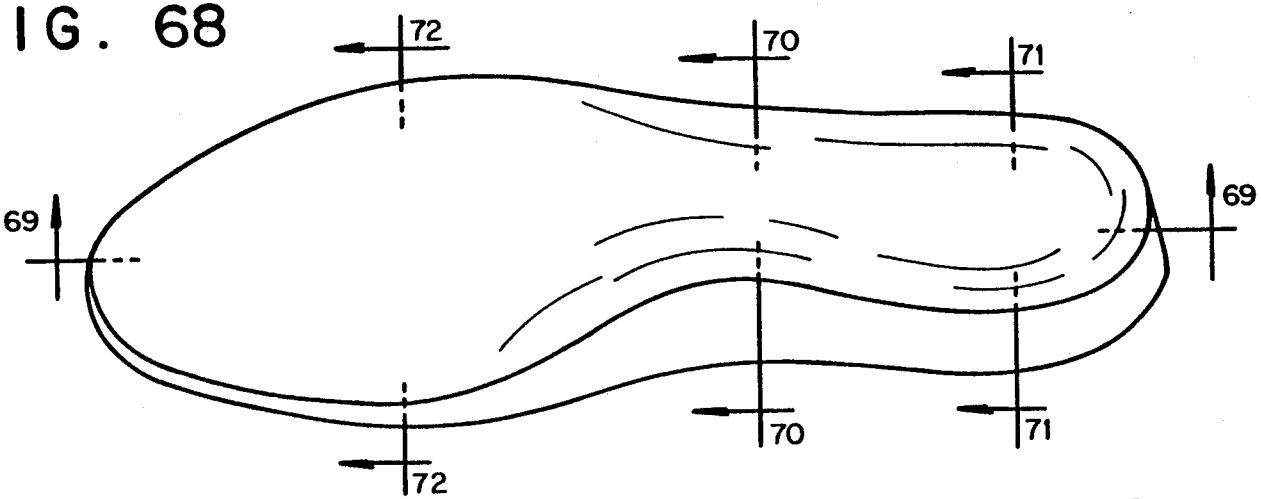
FIG. 68 is a perspective view of the shoe bottom of the invention having an encased stabilizer.
Figure 69:
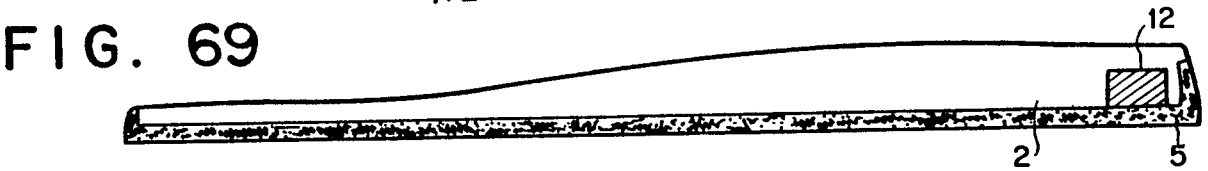
FIG. 69 is a longitudinal cross-section along lines 69—69 of FIG. 68.
Figure 71:
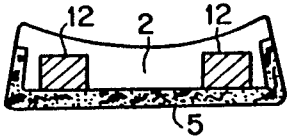
FIG. 71 is a transverse cross-section along lines 71—71 of FIG. 68.
Figure 70:
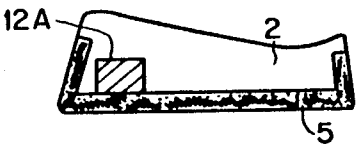
FIG. 70 is a transverse cross-section along lines 70—70 of FIG. 68.
Figure 72:
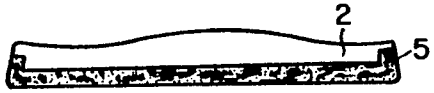
FIG. 72 is a transverse cross-section along lines 72—72 of FIG. 68.
Figure 73:
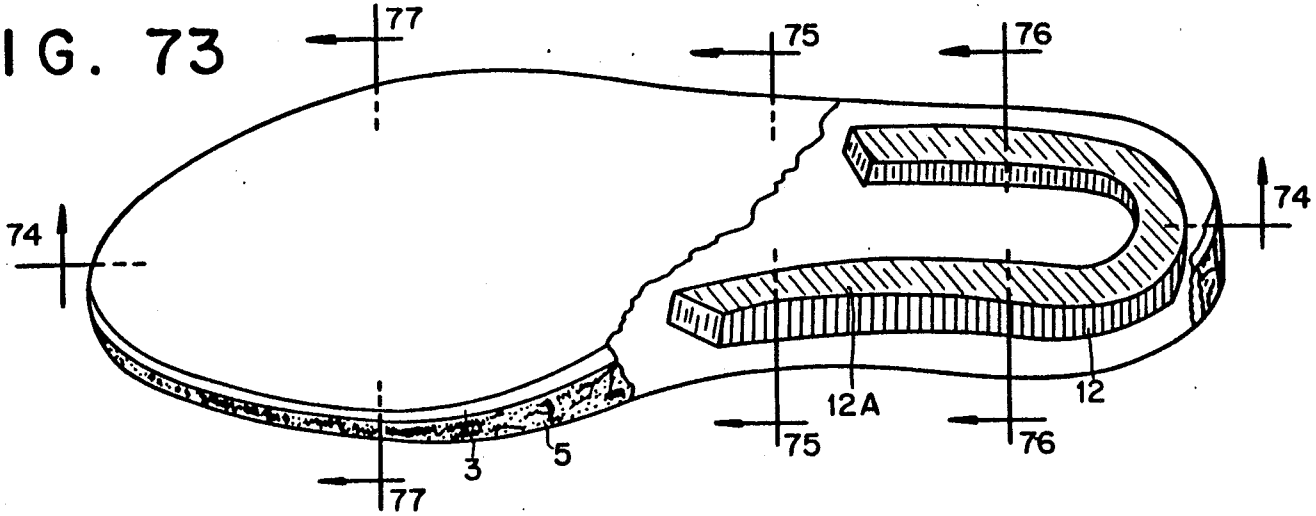
FIG. 73, is a partially broken away perspective view of a modified embodiment of the shoe bottom of FIG. 68.
Figure 74:
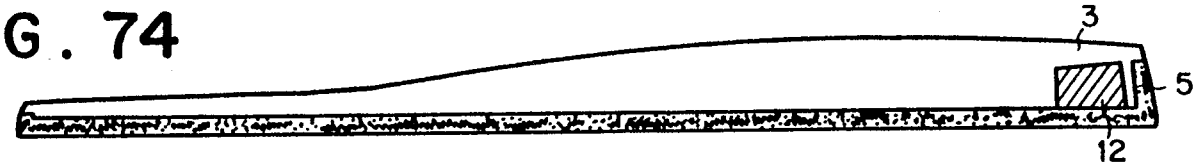
FIG. 74, is a longitudinal cross-section along lines 74—74 of FIG. 73.
Figure 76:
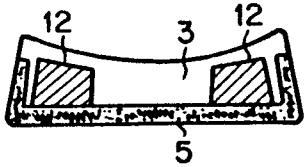
FIG. 76 is a transverse cross-section along lines 76—76 of FIG. 73.
Figure 75:
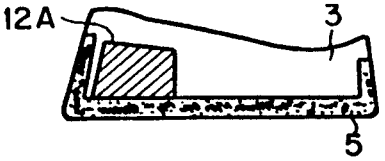
FIG. 75 is a transverse cross-section along lines 75—75 of FIG. 73.
Figure 77:
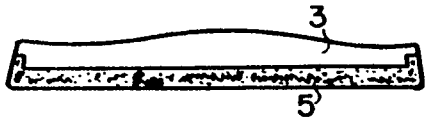
FIG. 77 is a transverse cross-section along lines 77—77.
Figure 78:
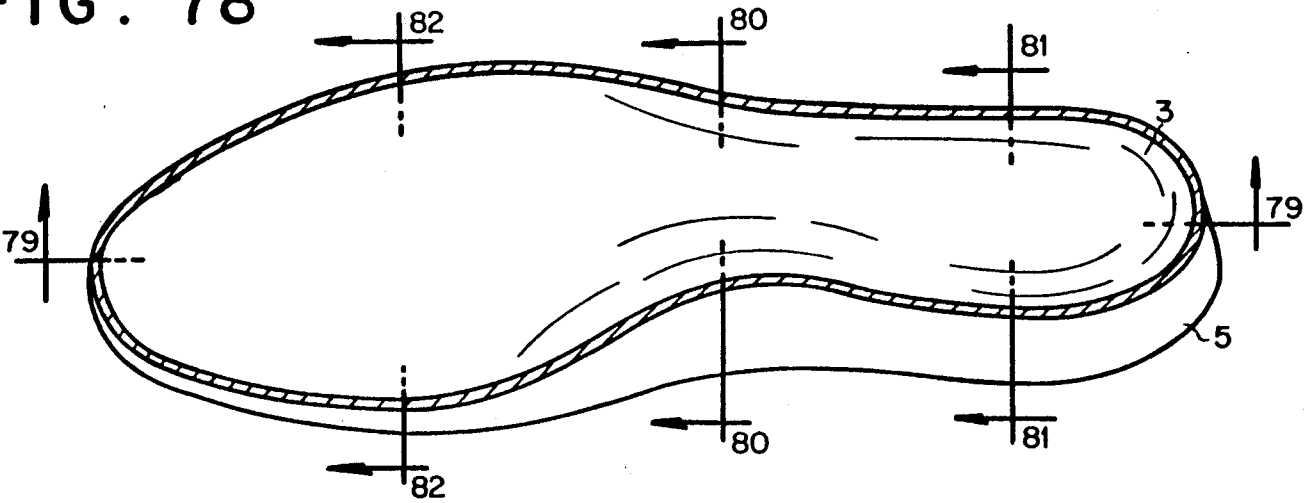
FIG. 78 is a perspective view of a shoe bottom of the invention with an outsole which covers the sides of the shoe bottom.
Figure 79:
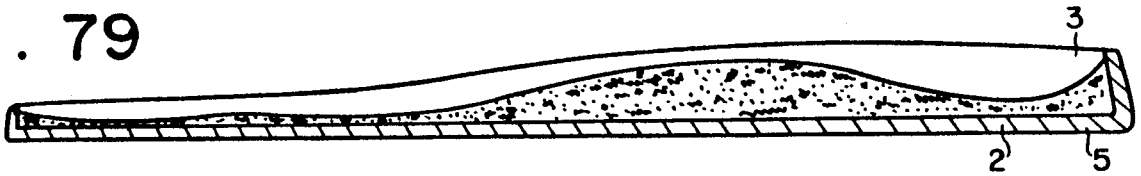
FIG. 79 is a longitudinal cross-section along lines 79—79 of FIG. 78.
Figure 81:
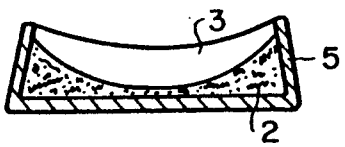
FIG. 81 is a transverse cross-section along lines 81—81 of FIG. 78.
Figure 80:
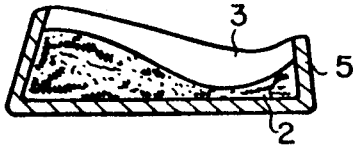
FIG. 80 is a transverse cross-section along lines 80—80 of FIG. 78.
Figure 82:
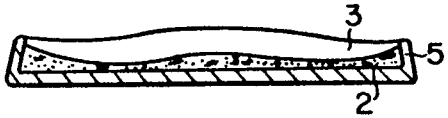
FIG. 82 is a transverse cross-section along lines 82—82 of FIG. 78.
Figure 83:
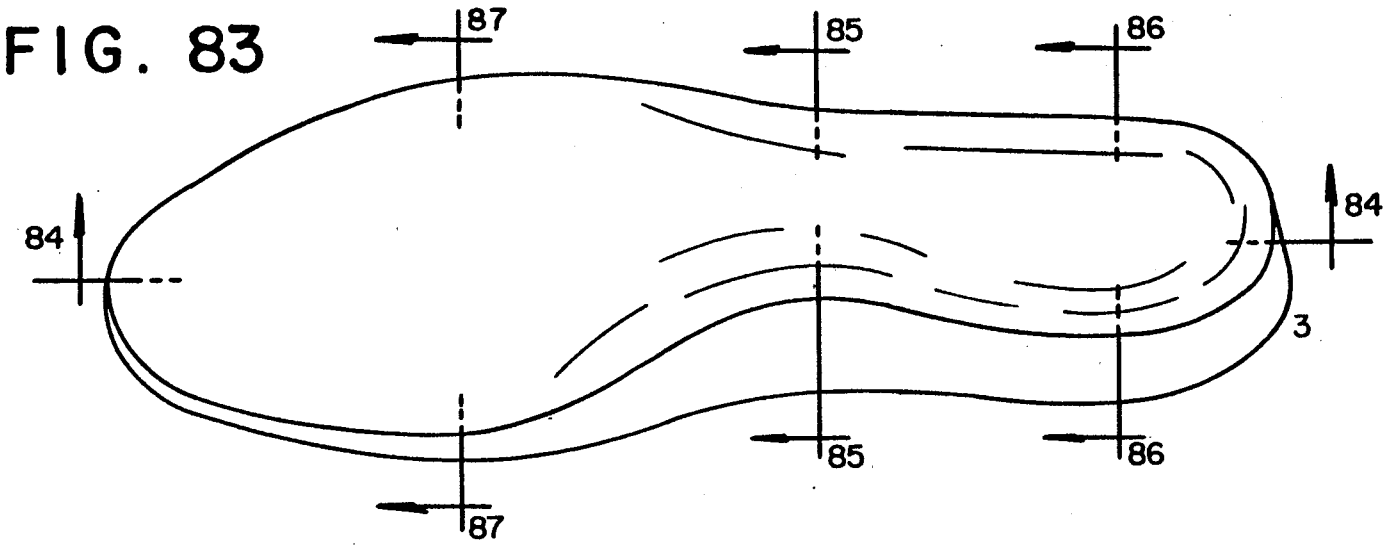
FIG. 83 is a perspective view of the shoe bottom of the invention having a first internal comfort stabilizer.
Figure 84:
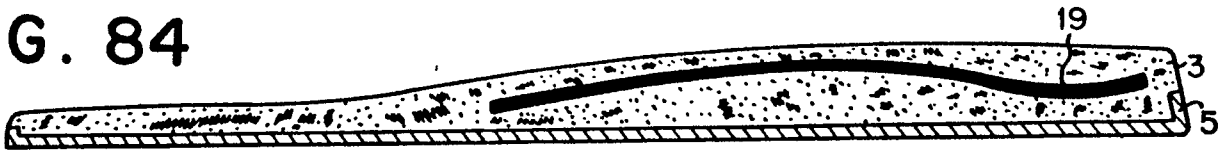
FIG. 84 is a longitudinal cross-section along lines 84—84 of FIG. 83.
Figure 86:
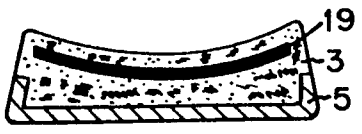
FIG. 86 is a transverse cross-section along lines 86—86 of FIG. 83.
Figure 85:
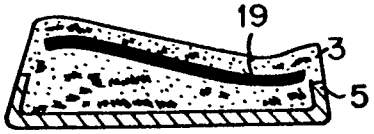
FIG. 85 is a transverse cross-section along lines 85—85 of FIG. 83.
Figure 87:
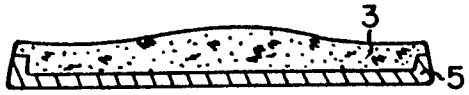
FIG. 87 is a transverse cross-section along lines 87—87 of FIG. 83.
Figure 88:
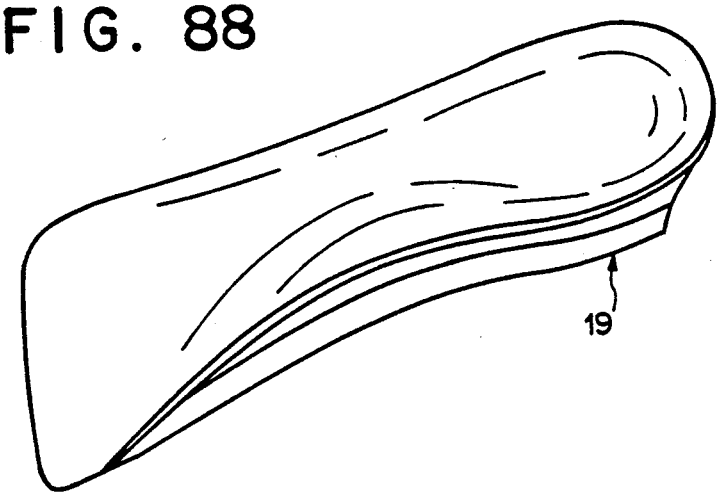
FIG. 88 is a perspective view of a second embodiment of the internal comfort stabilizer of the invention.
Figure 89:
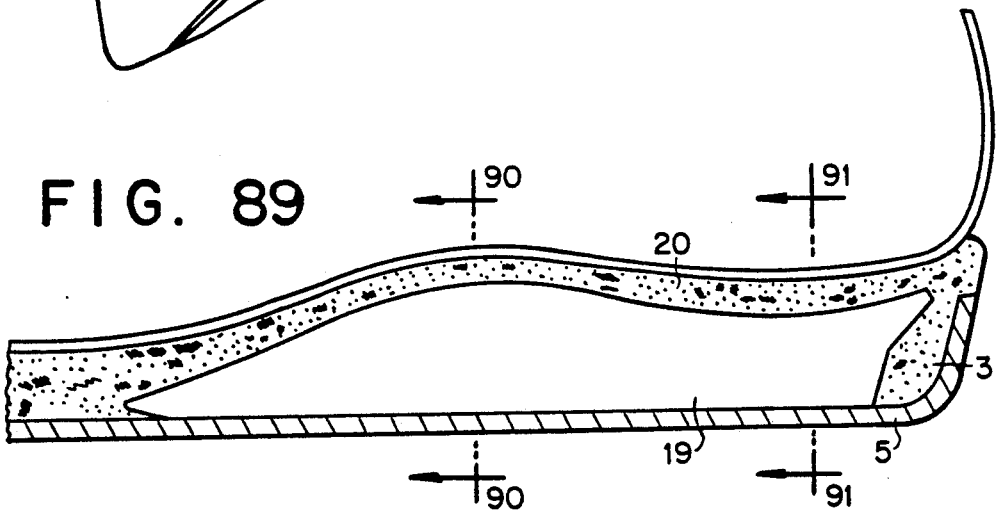
FIG. 89 is a longitudinal cross-section of a shoe bottom incorporating the stabilizer of FIG. 88.
Figure 90:
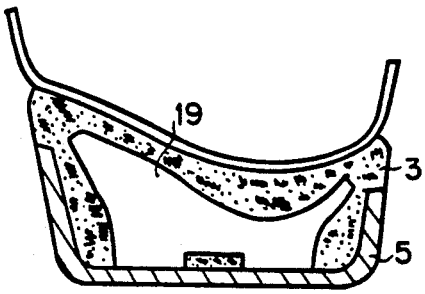
FIG. 90 is a transverse cross-section along lines 90—90 of FIG. 89.
Figure 91:
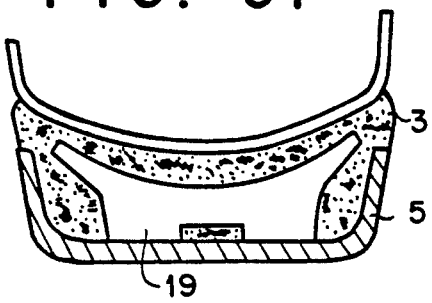
FIG. 91 is a transverse cross-section along lines 91—91 of FIG. 89.

Additional support may be provided by a heel cup wall 13, as shown in FIGS. 45–47. The heel cup wall 13 extends upward and slightly outward from the uppermost surface 4 in the heel portion of the shoe bottom. This increases the lateral support provided the heel.

FIGS. 48–67 show alternate embodiments of the present invention. As is seen in FIGS. 48–52 the contour of the lower layer may be provided by a single step 14 change in height about the perimeter. Beneath the arch the step is higher than around the toe portion of the shoe bottom.

A further variation is shown in FIGS. 53–57 wherein the bottom has two steps 15, 16 which soften the change in support which is provided in the shoe bottom of FIG. 48–52. A more subtle change in support is provided while still functioning to push the fatty tissue at the heel of a wearer's foot beneath the heel to provide cushioning.

To provide a smooth variation in stabilizing support the shoe bottom may be made in the form shown in FIGS. 58–62. In this embodiment a rounded step 17 is provided. This rounded step 17 performs the function of step 14 while permitting a variation in the support which changes gradually.

For an even more gradual change in stabilizing support of the shoe bottom of FIGS. 63–67 may be used. This shoe bottom has a thicker perimeter 18 which slopes gently inward toward the shoe bottom's center.

FIGS. 68–72 show a further use of stability inserts 12. In the depicted shoe bottom a dress shoe look is provided by positioning the horseshoe shaped insert 12 within the shoe bottom. This provides a uniform outward appearance to the shoe bottom. However, it is easily seen that one leg 12A of the insert extends beneath the arch to provide arch support. The insert may have an upper surface which slopes inward sightly (FIG. 73–77) to create a cup-type support to more comfortably force the foot's fatty tissue inward to provide a natural cushion for the foot.

The outsole 5 may be used as a shell sole. That is two layers of shoe bottom may be injection molded within outsole 5. This produces the shoe bottom of FIGS. 78–82. The outsole is molded within the molding apparatus, the upper mold piece or last is then changed to a last having the contour for the upper surface of the lower layer. The lower layer is then injection molded within outsole 5. The last is again changed and a last having the contour of the upper surface of the upper layer is used. The upper layer is then injection molded; the heat of the molding process attaches the three layers to one another. The upper may be captured by the shoe bottom during the molding process to attach it to the shoe bottom.

FIGS. 83–99 show the internal comfort stabilizer of the invention. The internal comfort stabilizer is made of a wire mesh-like material which permits the soft PU to flow through IT, or of solid material such as structural foam, molded plastic, firm foam, high-density foam or the like. The shoe bottoms are fabricated by insertion molding of the stabilizer within the shoe bottom. This permits a single density PU or PVC to be used with the stabilizer. The stabilizer may also be used in shoe bottoms made of additional layers of different density PU.

As shown in FIG. 83–87 the basic internal comfort stabilizer 19 starts at the back of the heel and extends to just short of the ball of the foot. This stiffens the rear of the shoe bottom but permits it to flex at the ball of the foot In this manner comfort stabilizer 19 supports the entire bottom of the foot from the heel to the ball of the foot. At the same time it facilitates flexing at the correct position. The rear part of the stabilizer piece may be tapered slightly to permit more soft material at the back of the heel to cushion during heel strike. The stabilizer is positioned low in the shoe bottom to permit a cushioning layer of material between the stabilizer and the foot.

In a dual density shoe bottom the first shot of material usually molds the lower firm layer. The comfort stabilizer can be molded in place at the same time. In this manner the stabilizer is captured by the lower layer and held in place by that layer while the second layer is molded. Alternatively, the comfort stabilizer may be inserted in the mold by hand prior to molding the second layer. However, it is preferred to have the stabilizer molded to the lower layer to prevent its movement while the second layer is molded. To further facilitate its attachment the comfort stabilizer may have holes in it to assist proper and complete flowing of the softer PU forming the upper layer.

Referring to FIGS. 83–87 there is shown a first embodiment of the comfort stabilizer 19 which provides stability and support with cushioning. The stabilizer is made of a fiberglass-like material. It is attached to the upper by foam pieces during the molding process. Alternatively, the stabilizer 19 may be held in place by protrusions 22 extending upward from the upper surface of the lower layer of firmer material. This positions the stabilizer with either a flat or contoured upper surface, in positions within the softer layer.

Figure 92:
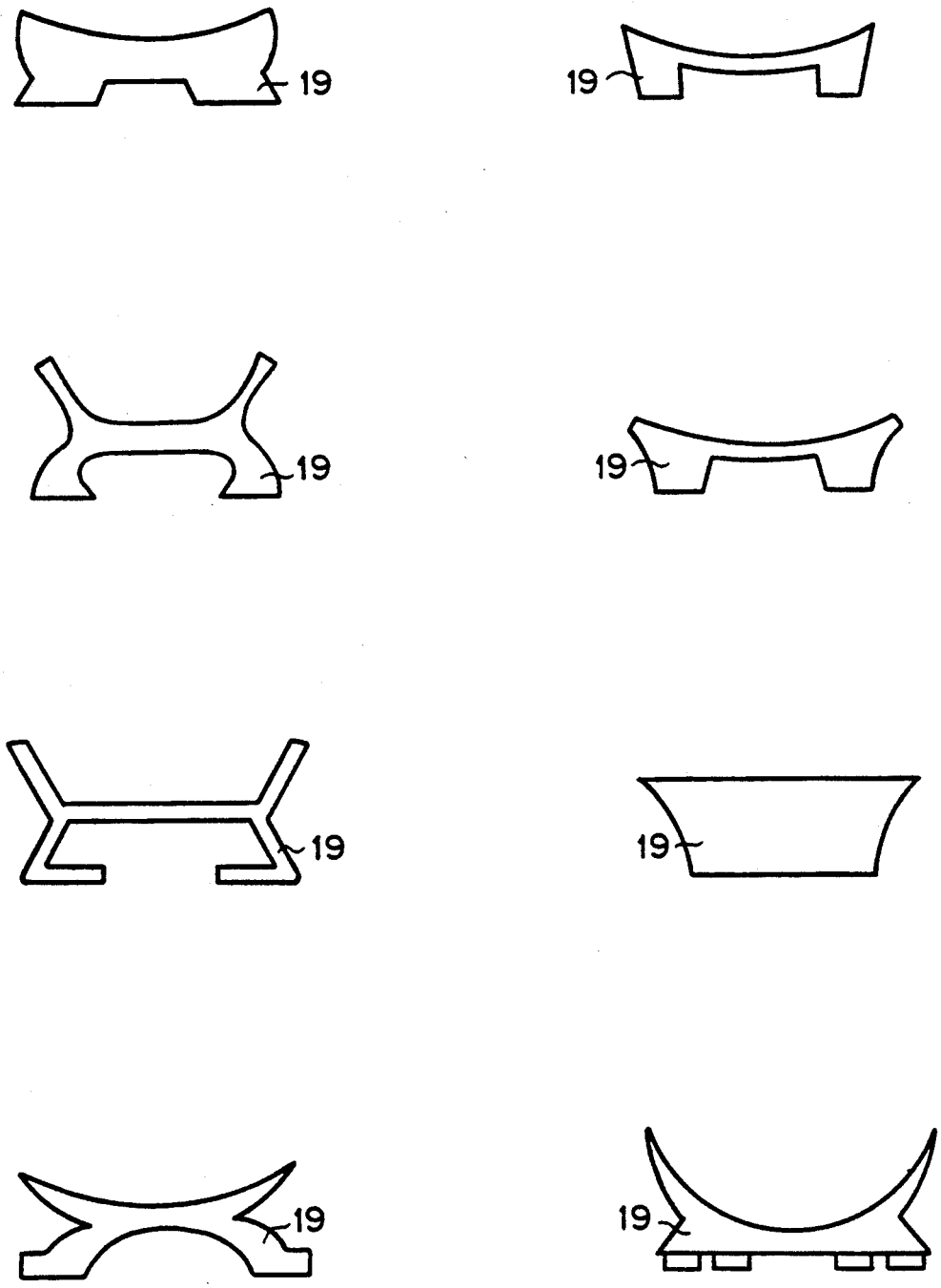
FIG. 92 shows cross-sectional views through the heel portion of various embodiments of the internal comfort stabilizer of the invention.

FIGS. 88–91 show a different embodiment of the internal comfort stabilizer 19. The stabilizer is shown in a dual density shoe bottom. The stabilizer 19 acts as a supporting beam which has an upper surface shaped to support a wearer's foot comfortably. It cups the foot while providing substantial rigidity to the shoe bottom from just behind the ball of the foot, to the heel. The stabilizer may take on one of many cross-sectional shapes. FIG. 92 shows some of the shapes found useful. Note the wide top surface spreading the support across a large area of the foot. These cross-sectional views are taken through the heel of the stabilizer. The comfort stabilizer is wedge shaped and tapers toward the ball of the foot.

Figure 93:
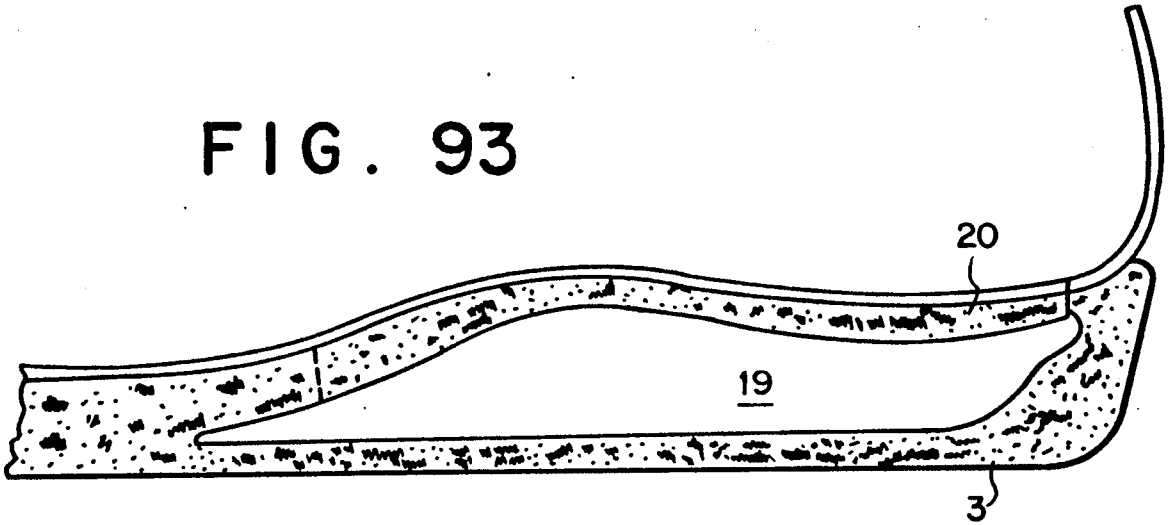
FIG. 93 is a longitudinal cross-section of a shoe bottom having the internal comfort stabilizer suspended.
Figure 95:
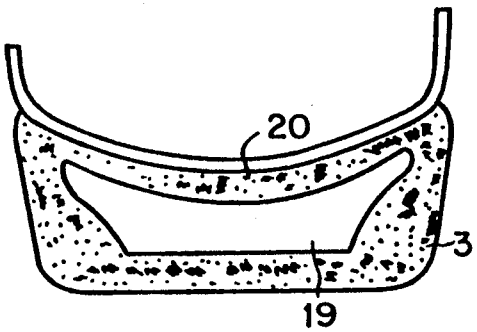
FIG. 95 is a transverse cross-sectional view along lines 95—95 of FIG. 93.
Figure 94:
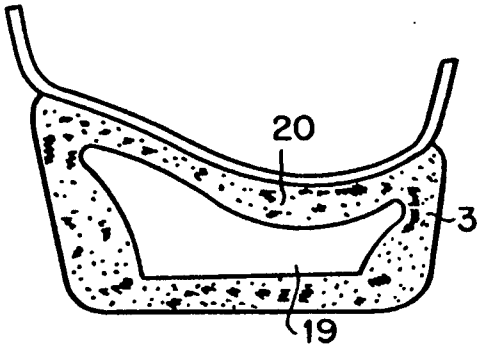
FIG. 94 is a transverse cross-sectional view along lines 94—94 of FIG. 93.

FIGS. 93–95 show the comfort stabilizer 19 in a shoe bottom of a single density PU. The stabilizer 19 is held in the mold by foam piece 20 which holds the stabilizer to the last. The stabilizer 19 is made of a hard material, therefor foam piece 20 also serves to cushion the stabilizer surface. Foam piece 20 may be made of shock foam or other shock absorbing material. Alternating the sole may be molded without S-foam 20.

Figure 96:
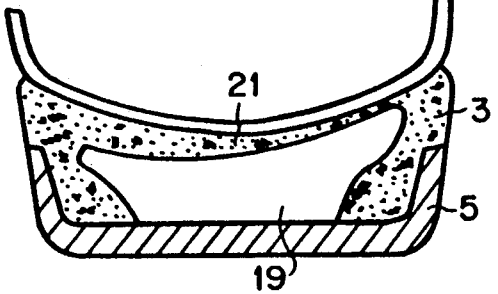
FIG. 96 is a transverse cross-sectional view of a shoe bottom with an internal comfort stabilizer for wearers with severe pronation problems.
Figure 97:
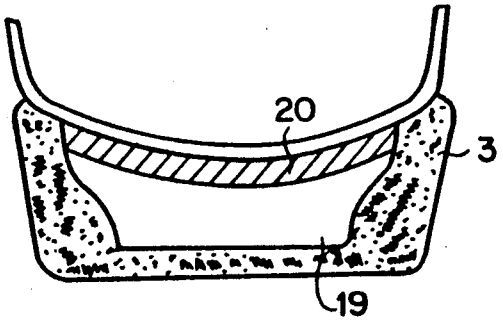
FIG. 97 is a transverse view of a shoe bottom having shock foam positioned above the internal comfort stabilizer.

FIGS. 96 & 97 show a stabilizer which is formed with an asymmetrical upper surface which is used for people who have a severe pronation problem. This type of stabilizer is useful for different types of running shoes. The stabilizer upper surface 21 may be shaped to provide additional support in areas required for a particular activity undertaken.

Figure 98:
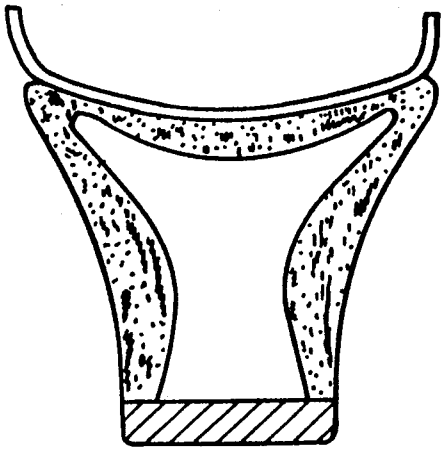
FIG. 98 is a transverse cross-section of a heel of a high heeled shoe with the internal comfort stabilizer of the invention.
Figure 99:
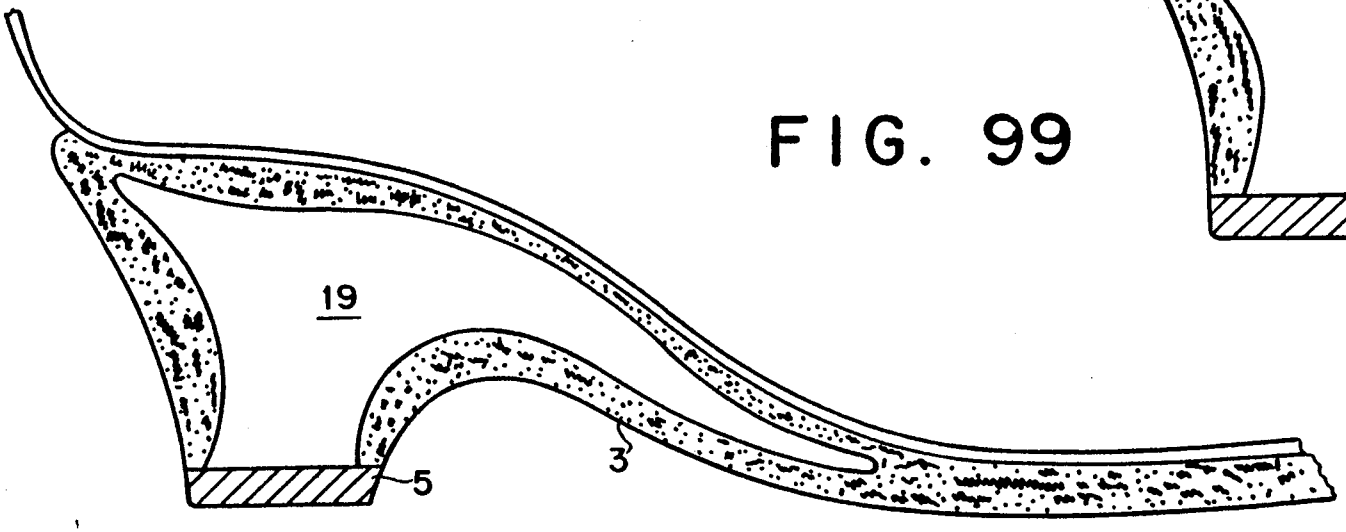
FIG. 99 is a longitudinal cross-section through the shoe bottom of FIG. 98.
Figures 100, 101, 102, 103:
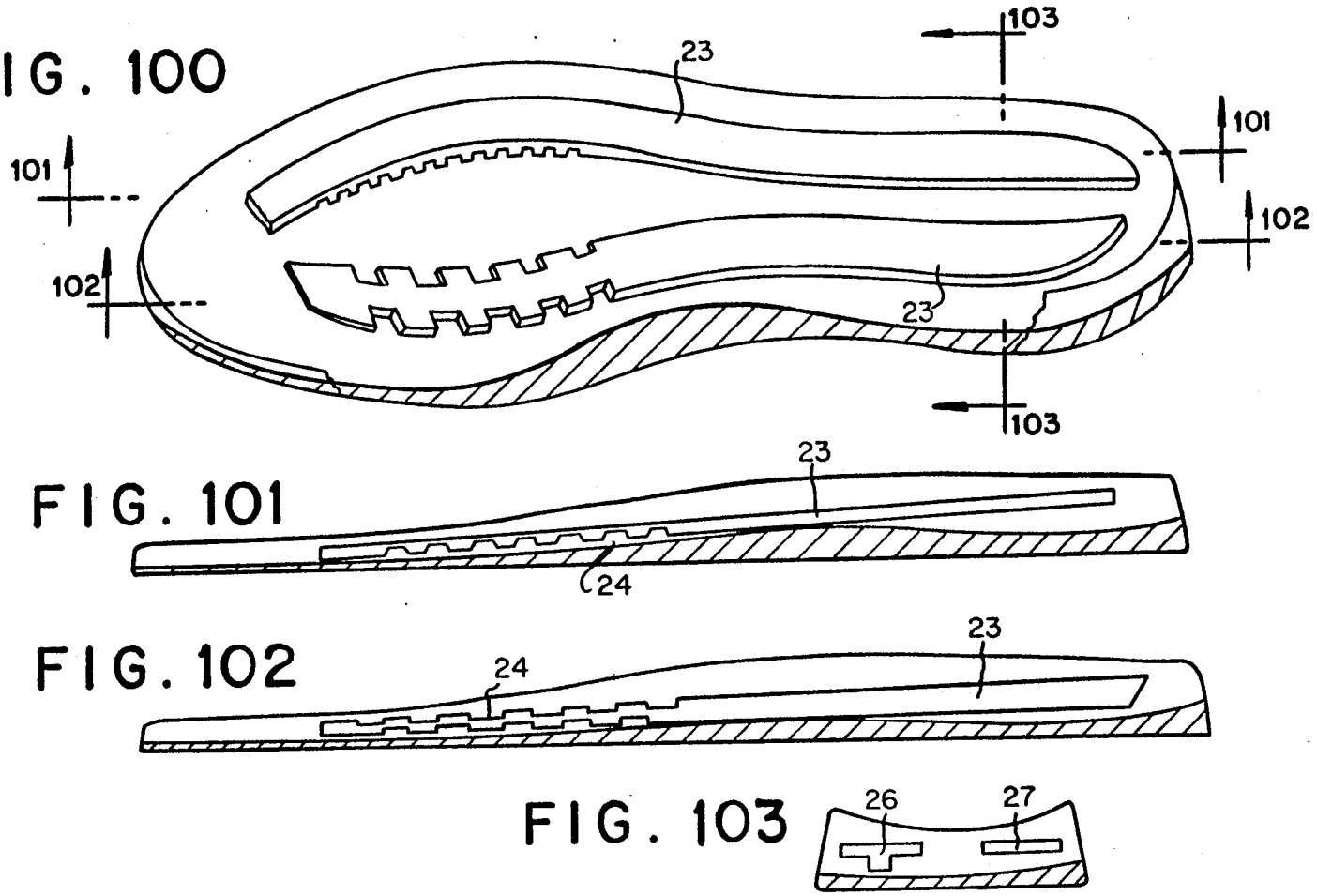
FIG. 100 is a perspective view partially broken away to show two alternate embodiments of stabilizers.
FIG. 101 is a longitudinal cross-section along lines 101—101 of FIG. 100.
FIG. 102 is a longitudinal cross-section along 102—102 of FIG. 100.
FIG. 103 is a transverse cross-section along lines 103—103 of FIG. 100.

FIGS. 98 & 99 show the stabilizer form which is used for high heeled shoes. The insert provides rigid support from the heel to the ball of the foot.

FIGS. 100–103 show a further embodiment of the stabilizer. Stabilizer bars 23 extend longitudinally within the shoe bottom. Grooves 24 or notches 25 (FIGS. 101 and 102) are provided in the area of the ball of the foot to permit the stabilizers to bend. The bars may have T-shaped cross-section 26 or may be flat as 27. The bars may taper slightly toward the ball of the foot.

Figure 104:
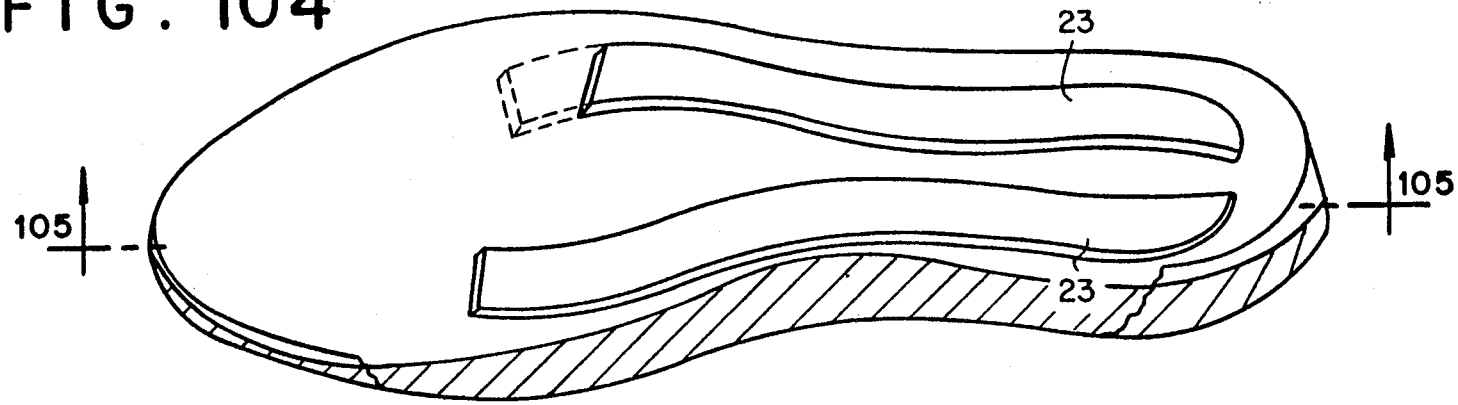
FIG. 104 is a perspective view, partially broken away, showing a further embodiment of the stabilizer of the invention.
Figure 105:
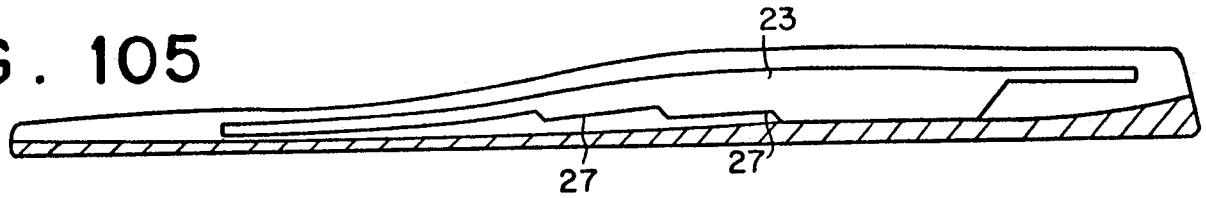
FIG. 105 is a longitudinal cross-section along lines 105—105 of FIG. 104.

FIGS. 104–105 show a stepped version of the stabilizer. Steps 27 are provided to change the thickness of the stabilizer.

Figure 106:
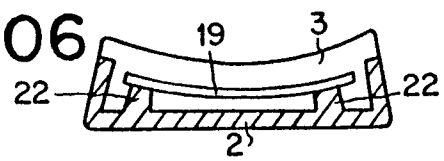
FIG. 106 is a transverse cross-section through the heel of a shoe bottom showing the mounting prongs.
Figure 107:
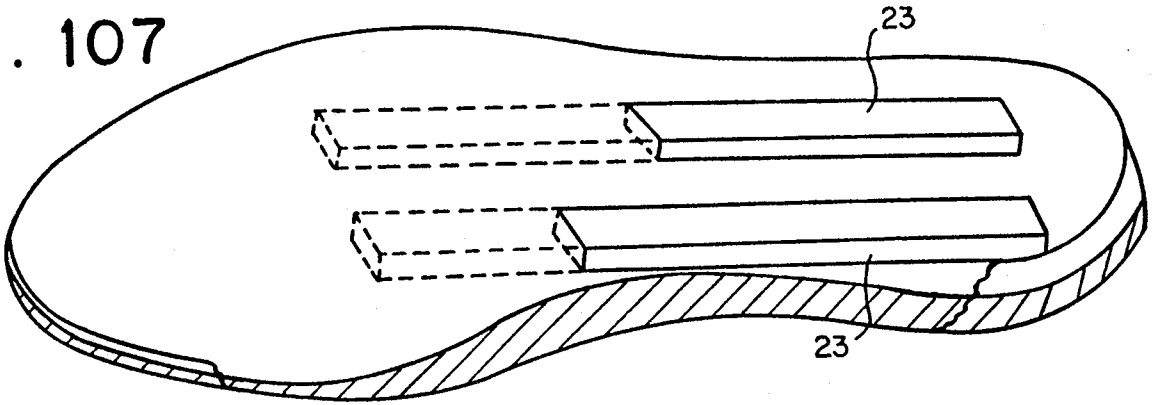
FIG. 107 is a perspective view, partially broken away, of a further embodiment of the stabilizer.
Figure 108:
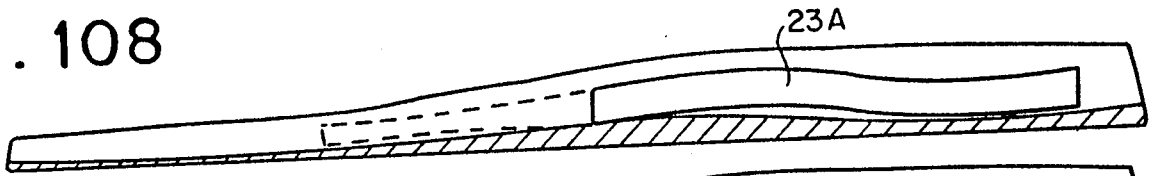
FIG. 108 is a longitudinal cross-section showing an embodiment of FIG. 107.
Figure 109:
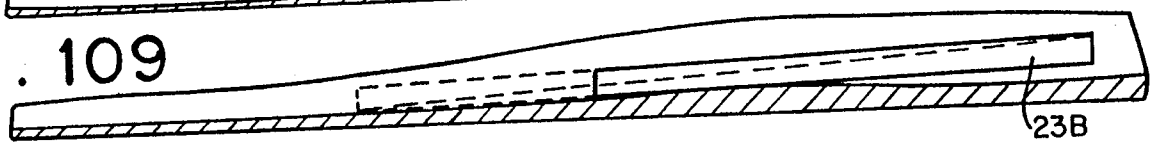
FIG. 109 is a longitudinal cross-section showing an alternate embodiment of FIG. 107.
Figure 110D:
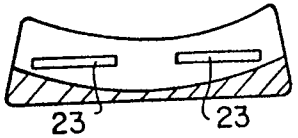
FIG. 110 is transverse cross-sectional views showing alternate shapes of the stabilizer.
Figure 110C:
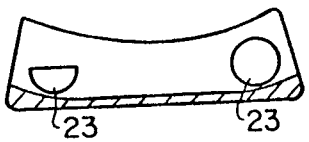
Figure 110B:
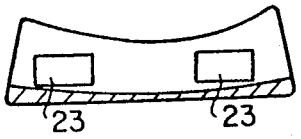
Figure 110A:
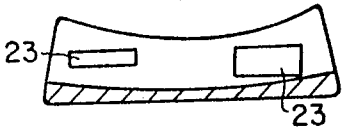
Figure 111:
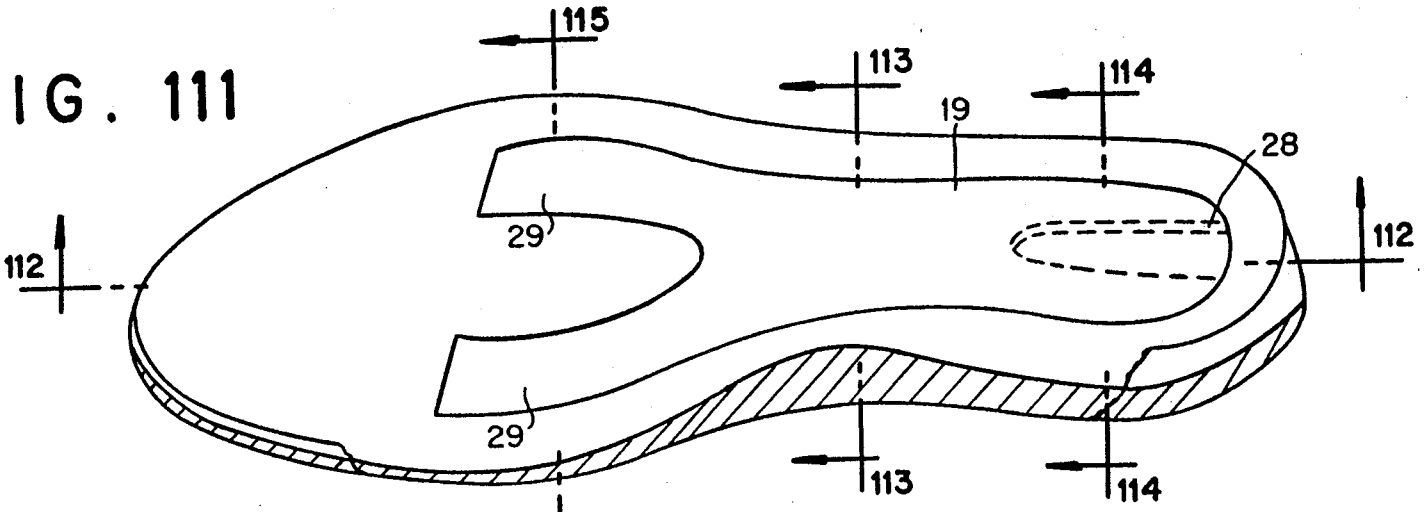
FIG. 111 is a perspective view showing a further embodiment of the stabilizer.
Figure 112:
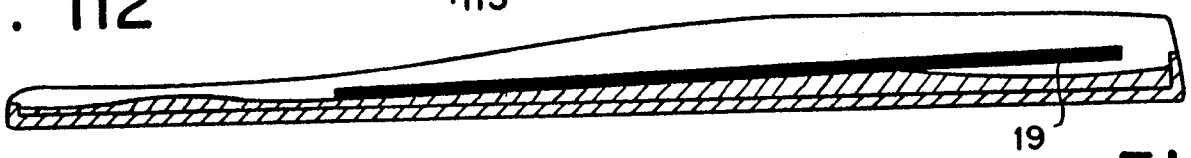
FIG. 112 is a longitudinal cross-section along lines 112—112 of FIG. 111.

FIG. 106 shows in more detail the protrusions 22 which are formed to extend upward from the lower layer. A stabilizer 19 is positioned on the protrusion and the upper layer is molded to surround the stabilizer.

FIGS. 107–110 shows stabilizer bars 23 which have two different shapes. The bars may be contoured 23A or straight 23B and may have a circular, semi-circular or rectangular shape as shown in FIG. 110.

Figure 116:
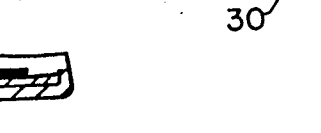
FIG. 116 is a transverse cross-sectional view showing an alternate embodiment of FIG. 114.
Figure 115:
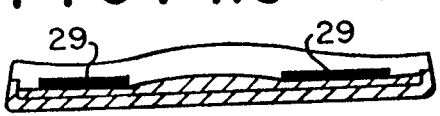
FIG. 115 is a transverse cross-section along lines 115—115 of FIG. 111.
Figure 114:
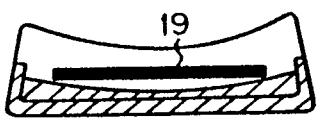
FIG. 114 is a transverse cross-section along lines 114—114 of FIG. 111.
Figure 113:
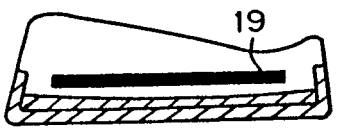
FIG. 113 is a transverse cross-section along lines 113—113 of FIG. 111.
Figure 117:
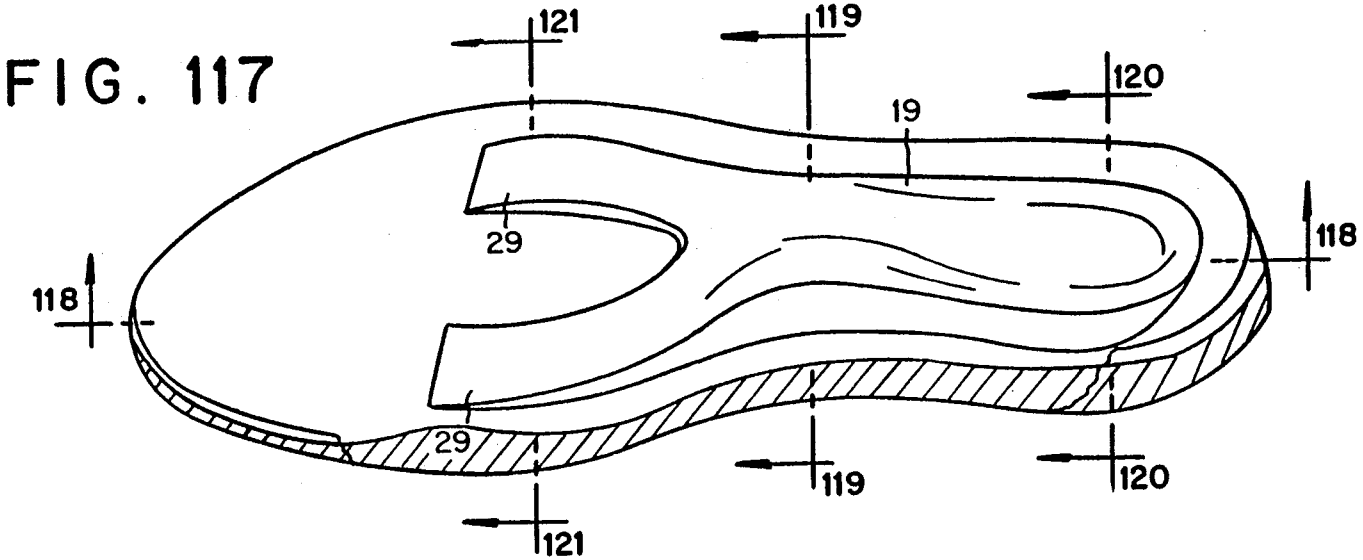
FIG. 117 is a perspective view, partially broken away, showing a further stabilizer.
Figure 118:
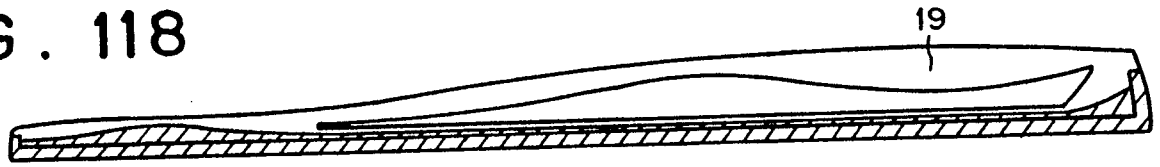
FIG. 118 is a longitudinal cross-section along lines 118—118 of FIG 117.
Figure 119:
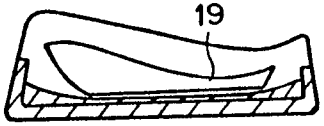
FIG. 119 is a transverse cross-section along lines 119—119 of FIG. 117.
Figure 120:
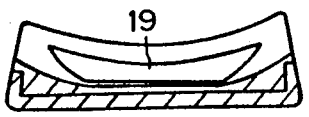
FIG. 120 is a transverse cross-section along lines 120—120 of FIG. 117.
Figure 121:
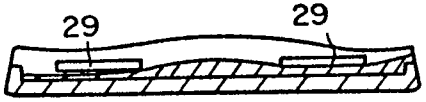
FIG. 121 is a transverse cross-section along lines 121—121 of FIG. 117.
Figure 127:
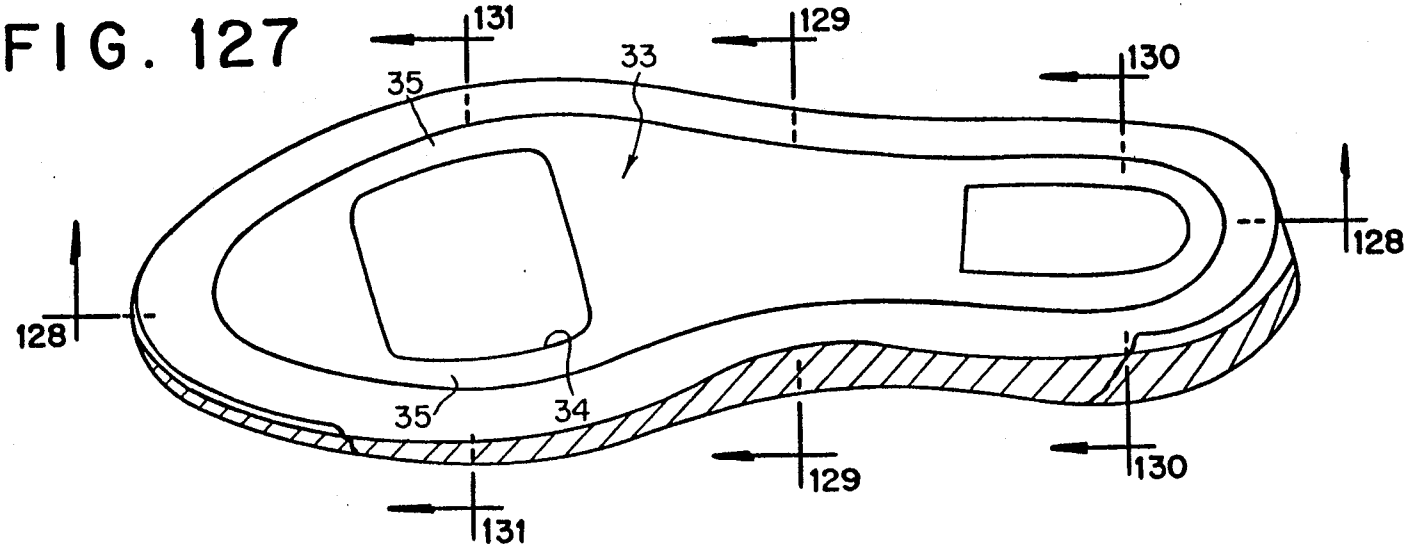
Figure 128:
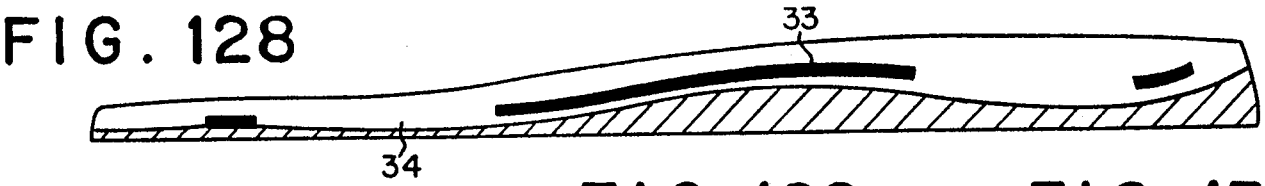
Figure 129:
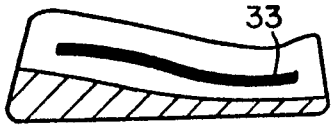
Figure 130:
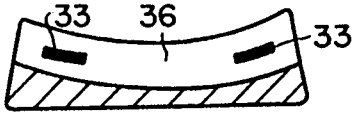

FIGS. 111–121 show a Y-shaped form of the stabilizer 19 which may have a heel cutout 28. The ball of the foot has arms 29 which support around the ball of the foot while cushioning the center. The stabilizer 19 may have constant thickness (FIGS. 111–116) or may be contoured (FIGS. 117–121) with a shape to optimize the use of the body's natural cushioning. To provide additional support to the heel, portions are thickened at 30 as shown in FIG. 116.

The embodiment of FIGS. 122–126 provides lateral support to the ball of the foot while permitting flexing. Main bar 31 extends from the heel to just short of the ball of the foot. Flex bars 31A are separated by portions 32 of PU which permit the shoe bottom to flex. The foot sinks down into the PU in the portions 32.

Figure 27:
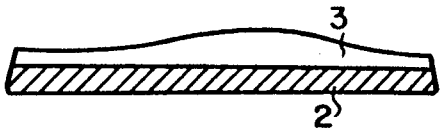
FIG. 27 is a transverse cross-section along lines 27—27 of FIG. 25.
Figure 30:
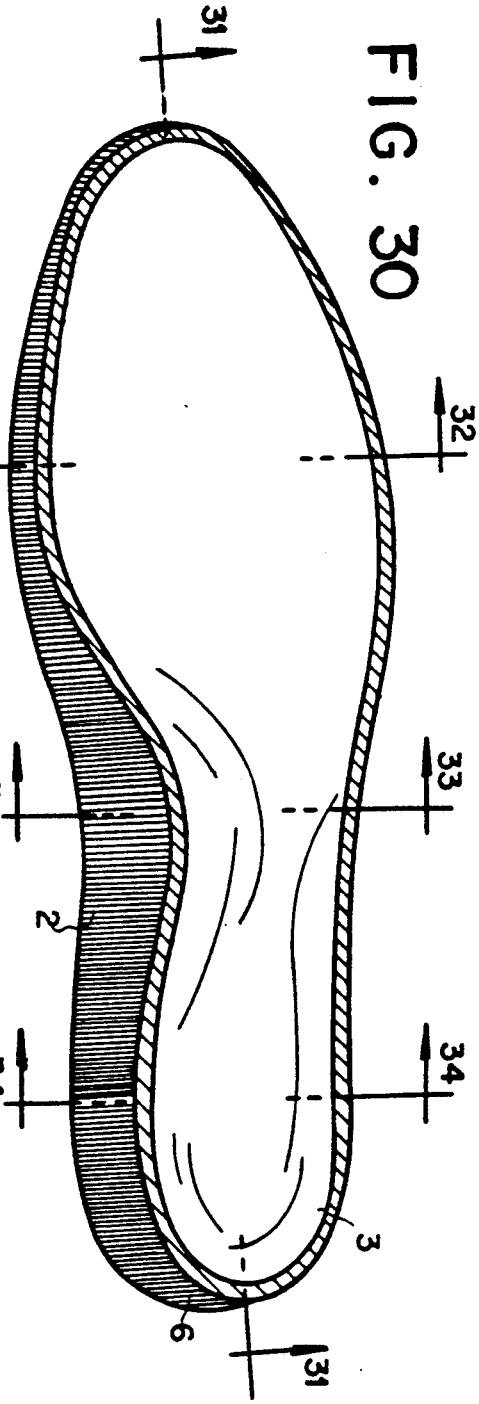
FIG. 30 is a perspective view of a modified sixth embodiment of the invention.
Figure 31:
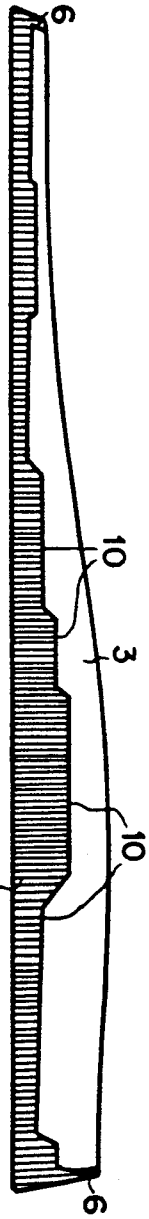
FIG. 31 is a longitudinal cross-section along lines 31—31 of FIG. 30.
Figure 32:
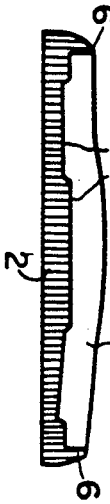
FIG. 32 is a transverse cross-section along lines 32—32 of FIG. 30.
Figure 33:
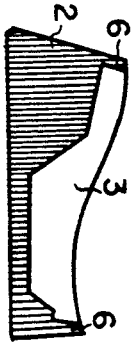
FIG. 33 is a transverse cross-section along lines 33—33 of FIG. 30.
Figure 34:
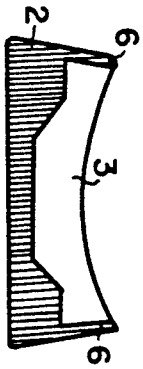
FIG. 34 is a transverse cross-section along lines 34—34 of FIG. 30.
Figure 36:
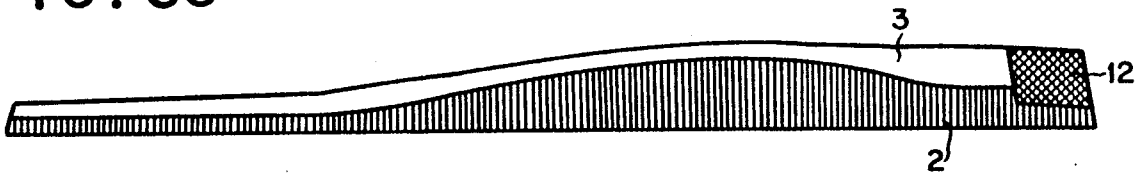
FIG. 36 is a longitudinal cross-section along lines 36—36 of FIG. 35.
Figure 35:
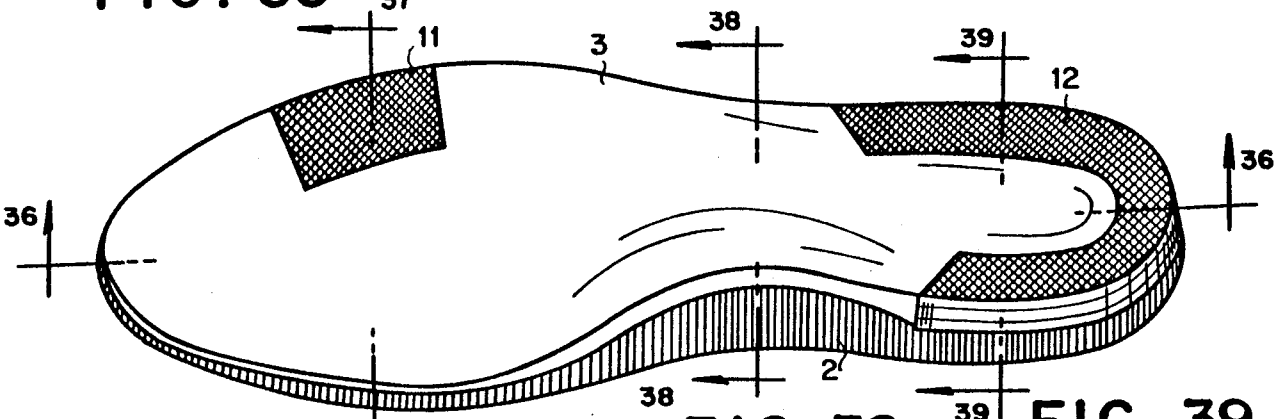
FIG. 35 is a perspective view of the shoe bottom of the invention having stabilizing inserts.
Figure 39:
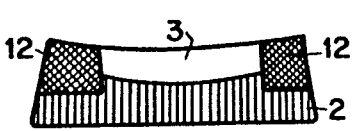
FIG. 39 is a transverse cross-section along lines 39—39 of FIG. 35.
Figure 38:
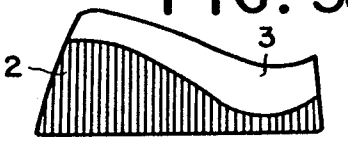
FIG. 38 is a transverse cross-section along lines 38—38 of FIG. 35.
Figure 37:
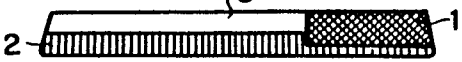
FIG. 37 is a transverse cross-section along lines 37—37 of FIG. 35.
Figure 131:
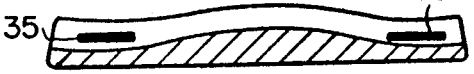

A single piece stabilizer 33 is shown in FIGS. 27–131. The single piece is slightly flexible at the forefoot due to the cutout to form opening 34. Thin legs 35 permit the stabilizer to bend. Heel opening 36 permits forcing the heel's fatty tissue beneath the heel for cushioning. This type of stabilizer is best used in a shoe bottom for a work shoe or hiking boot where a lot of flexibility is not required.

The stabilizer of FIGS. 132–136 must have some flexibility which reduces support, otherwise its application is in rugged footwear where bending is not required.

We claim:

1. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the toe area is positioned beneath a wearer's toes and is provided with a transverse cross-section and further wherein the thickness of said lower layer decreases from a central portion to outer periphery thereof.

2. The composite shoe bottom according to claim 1 wherein:

a) the lower layer has an upstanding rim along its periphery which surrounds at least a portion of the upper layer to provide lateral support to said upper layer.

3. The composite shoe bottom according to claim 1 wherein:

a) an outsole of wear-resistant material is attached beneath the lower layer to provide greater traction for the shoe bottom and protection against abrasion.

4. The composite shoe bottom according to claim 3 wherein:

a) the outsole extends up sides of the lower layer.

5. The composite shoe bottom according to claim 1 wherein:

a) stabilizing inserts of material harder than said upper layer extend upwardly from said lower layer to said uppermost surface to provide areas of increased support in said shoe bottom.

6. The composite shoe bottom according to claim 5 wherein:

a) at least one stabilizing insert extends around the outer periphery of the heel area to provide a greater support at the outer periphery than at a center of the heel.

7. The composite shoe bottom according to claim 5 wherein:

a) the stabilizing inserts are positioned in areas undergoing the greatest shock when the shoe bottom is worn.

8. The composite shoe bottom according to claim 1 wherein:

a) the height of the lower layer increases forming a slope up to the increased height.

9. A composite shoe bottom having a toe area, arch area and heel area, comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the lower layer includes a base with a plurality of spaced upstanding fingerlike projections defining said irregular contoured upper stabilizing surface; the upper layer is superposed upon the lower layer with said projections extending into said upper layer; and the projections are sized to bulge and distort under the weight of a wearer.

10. The composite shoe bottom according to claim 9 wherein:

a) the lower layer has a heel area and said projections extend higher at positions near the periphery of the heel area to provide a cupped shape to said heel area to force fatty tissue of the heel of a wearer beneath the heel for cushioning.

11. The composite shoe bottom according to claim 9 wherein:

a) in the arch area of the shoe bottom for positioning beneath an arch of a foot, the projections extend higher on the side under the arch than the projections on the opposite side to provide a raised area of said upper surface beneath said arch.

12. The composite shoe bottom according to claim 9 wherein:

a) there is a toe portion having projections extending higher at a central portion of the shoe bottom than the projections toward the outside of the shoe bottom.

13. A composited shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the increased height is provided by step increases in the thickness of the lower layer.

14. The composite shoe bottom according to claim 13 wherein:

a) a step increase in the height is provided in the arch area to give additional support to a wearer's arch.

15. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the heel area of the shoe bottom has a step increased in height along the periphery of the heel which is wider on one side of the heel than on the opposite side.

16. The composite shoe bottom according to any one of claims 1,9,13, or 15 wherein:

a) shock absorbing inserts extend upward from the lower layer in areas of the shoe bottom undergoing the greatest shock when the shoe bottom is worn.

17. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein shock absorbing inserts which are covered by said upper layer extend upward from the lower layer in areas of the shoe bottom undergoing the greatest shock when the shoe bottom is worn.

18. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the increased height of the lower layer is a step-like increase in height over the remainder of the layer.

19. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein: the increased height of the lower layer is formed as two step-like incremental increases in height.

20. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot; wherein the increased height forms a convex rounded edge facing the inner portion of the shoe bottom.

21. A composite shoe bottom having a toe area, arch area and heel area comprising:

a) a lower shaped layer of predetermined hardness capable of maintaining its shape against a wearer's weight;

b) an upper cushioning layer, softer than said lower layer, superposed in face-to-face relation upon said lower layer, said upper layer having a varying thickness to define an upper surface which is shaped to a contour complementary to the bottom surface of a wearer's foot; and, c) a stabilizer for stiffening said shoe bottom disposed within said upper layer and extending from said heel area toward said toe area, said stabilizer having a pair of forwardly extending arms at the forwardmost end of the stabilizer extending into the toe area of said shoe bottom and defining a notch therebetween.

22. The composite shoe bottom according to claim 21 wherein:

a) the stabilizer in the heel area defines a notch which provides peripheral support to the heel while cushioning the central portion.

23. The composite shoe bottom according to either claim 21 or 22 wherein:

a) the stabilizer has a wedge shape and contoured upper surface which is complemental to the shape of the bottom of a wearer's foot.

24. The composite shoe bottom according to either claim 21 or 22 wherein:

a) the periphery of the stabilizer is thicker than the center of the stabilizer.

25. A composite shoe bottom having a toe area, arch area, and heel area comprising:

a) a lower shaped layer of predetermined hardness capable of maintaining its shape against a wearer's weight;

b) an upper cushioning layer, softer than said lower layer, said upper layer having a varying thickness to define an upper most surface which is shaped to a contour complementary to the bottom surface of the wearer's foot; and c) a substantially stiff stabilizer disposed within said upper layer and extending from said heel area to and including said toe area to stiffen said shoe bottom and the stabilizer defines an opening in the area between the arch area and the toe area to provide cushioning to a ball of the foot and permit some flexibility in the area beneath the ball of the foot.

26. The composite shoe bottom according to claim 25 wherein:

a) the heel area defines an opening beneath the heel to provide cushioning directly below the heel and support about the periphery of the heel.

27. A composite shoe bottom according to claim 26 wherein:

a) the stabilizer forms a plurality of transversely extending pieces in the area between the arch area and toe area, said transversely extending pieces are separated by portions of said upper layer to permit flexing of said shoe bottom.

28. A composite shoe bottom having a toe area, arch area and heel area comprising:

a) a lower shaped layer of predetermined hardness capable of maintaining its shape against the wearer's weight and having an increased height around the periphery of the heel area and in the arch area to form an irregular contoured upper stabilizing surface for the wearer's foot; and b) an upper cushioning layer, softer than said lower layer, superposed in face-to-face relation upon said upper surface of the lower layer, said upper layer having a varying thickness to define an uppermost surface which is shaped to a contour complementary to the bottom surface of the wearer's foot, the increased height is provided by an insert which extends within the upper layer about the periphery of the heel portion to form a U-shape in a horizontal plane through the stabilizer.

29. The composite shoe bottom according to claim 28 wherein:

a) one leg of the u-shape extends beneath an arch of the shoe bottom to provide additional support to the arch of the foot.

30. The composite shoe bottom according any one of the claims 28 or 29 wherein:

a) the insert has an upper surface which slopes inward away from the shoe bottom periphery.

31. A composite shoe bottom comprising:

a) a shoe bottom body of at least one density of material forming a sole of a shoe;

b) a substantially rigid stabilizer having a wedge shape, disposed within the shoe bottom body, said stabilizer having a height which decreases from the heel toward the toe and defines an upper surface which is complemental to the bottom of a wearer's foot;

c) the shoe body has an outsole defining a bottom surface of the shoe and having an inner upper surface;

d) the comfort stabilizer has a lower surface which is in face-to-face position with the upper surface of the outsole; and e) a flexible material surrounds the comfort stabilizer to form the remainder of the shoe body and to provide cushioning between the comfort stabilizer and a wearer's foot.

32. A composite shoe bottom comprising:

a) a shoe bottom body of at least one density of material forming a sole of a shoe;

b) a substantially rigid stabilizer having a wedge shape, disposed within the shoe bottom body, said stabilizer having a height which decreases from the heel toward the toe and defines an upper surface which is complemental to the bottom of a wearer's foot; and c) the stabilizer has an increased height around the periphery of the heel to push the fatty tissue of the heel beneath the heel for cushioning thereof.

33. The composite shoe bottom according to any of the claims 31 or 32 wherein:

a) the comfort stabilizer extends from the heel of the shoe bottom to a point behind the ball of the foot.

34. The composite shoe bottom according to claim 33 wherein:

a) the comfort stabilizer is made of a material selected from the group plastic, high density foam, structural foam and firm foam.

35. A composite shoe bottom having a toe area, arch area and heel area comprising:

a) a lower shaped layer of predetermined hardness capable of maintaining its shape against the wearer's weight;

b) an upper cushioning layer, softer than said lower layer, superposed in face-to-face relation upon said lower layer, said upper layer having a varying thickness to define an uppermost surface which is shaped to a contour complementary to the bottom surface of the wearer's foot; and c) at least one stabilizer bar disposed within said cushioning layer extending in a longitudinal direction from beneath said heel area into said toe area to provide additional support to portions of the wearer's foot and the stabilizer bar defines a plurality of notches beneath the ball of the foot to permit flexing of the stabilizer between the arch area and the toe area.

36. The composite shoe bottom according to claim 35 wherein:

a) the stabilizer bar has a T-shaped cross-section.

37. The composite shoe bottom according to claim 35 wherein:

a) at least one stabilizer bar has a wavy shape to be disposed higher in said cushioning layer at positions where additional support to the wearer's foot is required and lower in said cushioning layer where additional cushioning is required.

38. A composite shoe bottom having a toe area, arch area and heel area comprising:

a) a lower shaped layer of predetermined hardness capable of maintaining its shape against the wearer's weight;

b) an upper cushioning layer, softer than said lower layer, superposed in face-to-face relation upon said lower layer, said upper layer having a varying thickness to define an uppermost surface which is shaped to a contour complementary to the bottom surface of the wearer's foot; and c) at least one stabilizer bar disposed within said cushioning layer extending in a longitudinal direction from beneath said heel area into said toe area to provide additional support to portions of the wearer's foot and the stabilizer bar tapers from the heel area to the toe area.

39. A composite shoe bottom having a toe area, arch area and heel area comprising:

a) a lower shaped layer of predetermined hardness capable of maintaining its shape against the wearer's weight;

b) an upper cushioning layer, softer than said lower layer, superposed in face-to-face relation upon said lower layer, said upper layer having a varying thickness to define an uppermost surface which is shaped to a contour complementary to the bottom surface of the wearer's foot; and c) at least one stabilizer bar disposed within said cushioning layer extending in a longitudinal direction from beneath said heel area into said toe area to provide additional support to portions of the wearer's foot and the stabilizer bars have step changes in vertical thickness to taper the stabilizer from the heel to the ball of the foot.

40. The composite shoe bottom according to claim 39 wherein:

a) the portion of said stabilizer beneath the heel area is cantilevered to provide flexing beneath the heel.

* * * * *